US010531198B2

(12) United States Patent
Walther

(10) Patent No.: US 10,531,198 B2
(45) **Date of Patent: *Jan. 7, 2020**

(54) APPARATUS AND METHOD FOR DECOMPOSING AN INPUT SIGNAL USING A DOWNMIXER

(71) Applicant: Fraunhofer-Gesellschaft zur Foerderung der angewandten Forschung e.V., Munich (DE)

(72) Inventor: Andreas Walther, Crissier (CH)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/209,638

(22) Filed: Dec. 4, 2018

(65) Prior Publication Data

US 2019/0110129 A1 Apr. 11, 2019

Related U.S. Application Data

(63) Continuation of application No. 13/911,791, filed on Jun. 6, 2013, now Pat. No. 10,187,725, which is a (Continued)

(30) Foreign Application Priority Data

May 11, 2011 (EP) ..... 11165746

(51) Int. Cl.

| | |
|---|---|
| ***H04R 5/04*** | (2006.01) |
| ***H04S 3/00*** | (2006.01) |
| ***G10L 19/02*** | (2013.01) |

(52) U.S. Cl.

CPC ..... *H04R 5/04* (2013.01); *G10L 19/02* (2013.01); *H04S 3/008* (2013.01); *H04S 2400/03* (2013.01); *H04S 2400/15* (2013.01)

(58) Field of Classification Search

CPC combination set(s) only.
See application file for complete search history.

(56) References Cited

U.S. PATENT DOCUMENTS 5,065,759 A 11/1991 Begemann
5,912,976 A 6/1999 Klayman et al.
(Continued)

FOREIGN PATENT DOCUMENTS

CN 1189081 C 7/1998
JP 2001503942 A 3/2001
(Continued)

OTHER PUBLICATIONS

Avendano, Carlos et al., "A Frequency-Domain Approach to Multichannel Upmix", Journal of the Audio Engineering society, Audio, Engineering Society, vol. 52, No. 7/8, Jul./Aug. 2004, pp. 740-749.
(Continued)

*Primary Examiner* — Duc Nguyen
*Assistant Examiner* — Assad Mohammed
(74) *Attorney, Agent, or Firm* — Perkins Coie LLP; Michael A. Glenn

(57) ABSTRACT

An apparatus for decomposing a signal having an number of at least three channels includes an analyzer for analyzing a similarity between two channels of an analysis signal related to the signal having at least two analysis channels, wherein the analyzer is configured for using a pre-calculated frequency dependent similarity curve as a reference curve to determine the analysis result. The signal processor processes the analysis signal or a signal derived from the analysis signal or a signal, from which the analysis signal is derived using the analysis result to obtain a decomposed signal.

15 Claims, 13 Drawing Sheets

Related U.S. Application Data continuation of application No. PCT/EP2011/070700, filed on Nov. 22, 2011.

(60) Provisional application No. 61/421,927, filed on Dec. 10, 2010.

(56) References Cited

U.S. PATENT DOCUMENTS

| | | | | |
|---|---|---|---|---|
| 6,052,658 | A | 4/2000 | Wang et al. | |
| 6,694,027 | B1 | 2/2004 | Schneider et al. | |
| 7,254,500 | B2 | 8/2007 | Makeig et al. | |
| 7,563,975 | B2 | 7/2009 | Leahy et al. | |
| 7,809,556 | B2 | 10/2010 | Goto et al. | |
| 2005/0007091 | A1 | 1/2005 | Makeig et al. | |
| 2005/0216262 | A1 | 9/2005 | Fejzo | |
| 2006/0004583 | A1* | 1/2006 | Herre | G10L 19/008 704/500 |
| 2006/0233380 | A1 | 10/2006 | Holzer et al. | |
| 2007/0035667 | A1* | 2/2007 | Ying | H04H 40/45 348/738 |
| 2007/0107585 | A1 | 5/2007 | Leahy et al. | |
| 2007/0140499 | A1* | 6/2007 | Davis | G10L 19/008 381/23 |
| 2007/0154019 | A1* | 7/2007 | Kim | H04S 1/00 381/17 |
| 2007/0165868 | A1 | 7/2007 | Klayman et al. | |
| 2007/0255562 | A1* | 11/2007 | Kurniawati | G10L 19/035 704/230 |
| 2007/0269063 | A1 | 11/2007 | Goodwin et al. | |
| 2007/0297519 | A1* | 12/2007 | Thompson | G10L 19/008 375/241 |
| 2008/0120123 | A1 | 5/2008 | Chow | |
| 2008/0240338 | A1 | 10/2008 | Boese et al. | |
| 2009/0252341 | A1 | 10/2009 | Goodwin | |
| 2010/0061558 | A1* | 3/2010 | Faller | G10L 19/008 381/23 |
| 2011/0022206 | A1 | 1/2011 | Scharrer et al. | |
| 2013/0070927 | A1 | 3/2013 | Harma et al. | |
| 2014/0180674 | A1 | 6/2014 | Neuhauser et al. | |

FOREIGN PATENT DOCUMENTS

| | | | | |
|---|---|---|---|---|
| JP | 2004354589 | A | 12/2004 | |
| RU | 2315371 | C2 | 1/2008 | |
| RU | 2363116 | C1 | 7/2009 | |
| RU | 2367033 | C2 | 9/2009 | |
| RU | 2387023 | C2 | 4/2010 | |
| WO | 2009100876 | A1 | 8/2009 | |
| WO | 2010092568 | A1 | 8/2010 | |
| WO | 2011058484 | A1 | 5/2011 | |
| WO | WO-2011058484 | A1 * | 5/2011 | G10L 19/008 |

OTHER PUBLICATIONS

Cook, Richard et al., "Measurement of correlation coefficients in reverberant sound fields", Journal of the Acoustical Society of America, vol. 27, No. 6, pp. 1072-1077, Nov. 1955.

Duda, Richard et al., "Range dependence of the response of a spherical head model", Journal of the Acoustical Society of America, vol. 104, No. 5, pp. 3048-3058, Nov. 1998.

Faller "A highly directive 2-capsule based microphone system", Preprint 123rd Conv. Aud. Eng. Soc., Oct. 2007.

Faller, Christof , "Multiple-loudspeaker playback of stereo signals", Journal of the Audio Engineering Society, vol. 54, No. 11, pp. 1051-1064, Nov. 2006.

Glasberg, Brian et al., "Derivation of auditory filter shapes from notched-noise data", Hearing Research, vol. 47, pp. 103-138, 1990.

Goodwin, M. et al., "Primary-ambient signal decomposition and vector-based localization for spatial audio coding and enhancement", Proc. of ICASSP 2007, 2007.

Jakka, Julia , "Binaural to Multichannel Audio Upmix", Ph.D. thesis, Master's Thesis, Helsinki University of Technology, 2005.

Merimaa, Juha et al., "Spatial impulse response rendering", Proc. of the 7th Int. Conf. on Digital Audio Effects (DAFx'04), 2004.

Pulkki, Ville , "Spatial sound reproduction with directional audio coding", Journal of the Audio Engineering Society, vol. 55, No. 6, pp. 503-516, Jun. 2007.

Rafaely, Boaz , "Spatially Optimal Wiener Filtering in a Reverberant Sound Field", IEEE Workshop on Applications of Signal Processing to Audio and Acoustics 2001, Oct. 21 to 24, 2001, New Paltz, New York.

Usher, John et al., "Enhancement of spatial sound quality: A new reverberation-extraction audio upmixer", IEEE Transactions on Audio, Speech, and Language Processing, vol. 15, No. 7;, Sep. 2007, pp. 2141-2150.

* cited by examiner

Cross-correlation *(r)* as a function of *kd* in two-dimensional and three-dimensional ideal diffuse sound fields IC($f_c$) for two sound sources at azimuth ± 30°, with head orientation 0°

Two sound sources at azimuth ± 30°, with head orientation 25°

Four sound sources at azimuth
{± 30°, ±110°}, with head orientation 25° eight sound sources at
azimuth {0°, ±45, ± 90°, ±135°. ±180},
with head orientation 25°

$$\begin{pmatrix} \overline{X}_1(m,i) \\ \overline{X}_2(m,i) \end{pmatrix} = \begin{pmatrix} 1 & 0 & \frac{1}{\sqrt{2}} & 1 & 0 \\ 0 & 1 & \frac{1}{\sqrt{2}} & 0 & 1 \end{pmatrix} \begin{pmatrix} X_1(m,i) \\ \vdots \\ X_5(m,i) \end{pmatrix}, \tag{1}$$

$$\begin{pmatrix} Y_{1D}(m,i) \\ \vdots \\ Y_{ND}(m,i) \end{pmatrix} = W_D(m,i) \begin{pmatrix} X_1(m,i) \\ \vdots \\ X_N(m,i) \end{pmatrix} \tag{2}$$

$$\begin{pmatrix} Y_{1A}(m,i) \\ \vdots \\ Y_{NA}(m,i) \end{pmatrix} = W_A(m,i) \begin{pmatrix} X_1(m,i) \\ \vdots \\ X_N(m,i) \end{pmatrix}, \tag{3}$$

$$\begin{aligned} \overline{X}_1 &= D_1 + A_1 \\ \overline{X}_2 &= D_2 + A_2, \end{aligned} \tag{4}$$

$$\begin{aligned} \hat{D}_1 &= W_D \cdot \overline{X}_1 \\ \hat{D}_2 &= W_D \cdot \overline{X}_2. \end{aligned} \tag{5}$$

$$\begin{aligned} J &= E\{|D_1 - \hat{D}_1|^2\} + E\{|D_2 - \hat{D}_2|^2\} \\ &= (W_d - 1)^2 P_D + W_d^2 P_A, \end{aligned} \tag{6}$$

$$\begin{aligned} P_D &= E\{|D_1|^2\} + E\{|D_2|^2\} \\ P_A &= E\{|A_1|^2\} + E\{|A_2|^2\}. \end{aligned} \tag{7}$$

$$W_D = \frac{P_D}{P_D + P_A}. \tag{8}$$

$$W_A = \frac{P_A}{P_D + P_A} = 1 - W_d. \tag{9}$$

WIENER FILTERING FOR ANALYSIS

FIG 11A $$\begin{aligned}\mathrm{Re}(E\{\check{X}_1\check{X}_2^*\}) &= \mathrm{Re}(E\{D_1+A_1)(D_2^*+A_2^*)\}) \\ &= \mathrm{Re}(E\{D_1D_2^*\}) \\ &= \sqrt{E\{|D_1|^2\}E\{|D_2|^2\}}.\end{aligned} \tag{10}$$

$$\begin{aligned}E\{|D_1|^2\} &= E\{|\bar{X}_1|^2\}-E\{|A_1|^2\} \\ E\{|D_2|^2\} &= E\{|\bar{X}_2|^2\}-E\{|A_2|^2\}.\end{aligned} \tag{11}$$

$$\begin{aligned}E\{|D_1|^2\} &= E\{|\bar{X}_1|^2\}-\frac{P_A}{2} \\ E\{|D_2|^2\} &= E\{|\bar{X}_2|^2\}-\frac{P_A}{2}.\end{aligned} \tag{12}$$

$$P_D+P_A = E\{|\bar{X}_1|^2\}+E\{|\bar{X}_2|^2\}, \tag{13}$$

$$P_D=\sqrt{(E\{|\bar{X}_1|^2\}-E\{|\bar{X}_2|^2\})^2+4\mathrm{Re}(E\{\bar{X}_1\bar{X}_2^*\})^2} \tag{14}$$

$$P_A=E\{|\bar{X}_1|^2\}+E\{|\bar{X}_2|^2\}-P_D. \tag{15}$$

WIENER FILTERING FOR ANALYSIS

FIG 11B

APPARATUS AND METHOD FOR DECOMPOSING AN INPUT SIGNAL USING A DOWNMIXER

CROSS-REFERENCE TO RELATED APPLICATIONS

This application is a continuation of copending U.S. patent application Ser. No. 13/911,791 filed Jun. 6, 2013, which is incorporated herein by reference in its entirety and which is a continuation of International Application No. PCT/EP2011/070700, filed Nov. 22, 2011, which is incorporated herein by reference in its entirety, and additionally claims priority from US Application No. 61/421,927, filed Dec. 10, 2010, and European Application 11165746.6, filed May 11, 2011, which are all incorporated herein by reference in their entirety.

BACKGROUND OF THE INVENTION

The present invention relates to audio processing and, in particular to audio signal decomposition into different components such as perceptually distinct components.

The human auditory system senses sound from all directions. The perceived auditory (the adjective auditory denotes what is perceived, while the word sound will be used to describe physical phenomena) environment creates an impression of the acoustic properties of the surrounding space and the occurring sound events. The auditory impression perceived in a specific sound field can (at least partially) be modeled considering three different types of signals at the car entrances: The direct sound, early reflections, and diffuse reflections. These signals contribute to the formation of a perceived auditory spatial image.

Direct sound denotes the waves of each sound event that first reach the listener directly from a sound source without disturbances. It is characteristic for the sound source and provides the least-compromised information about the direction of incidence of the sound event. The primary cues for estimating the direction of a sound source in the horizontal plane are differences between the left and right ear input signals, namely interaural time differences (ITDs) and interaural level differences (ILDs). Subsequently, a multitude of reflections of the direct sound arrive at the ears from different directions and with different relative time delays and levels. With increasing time delay, relative to the direct sound, the density of the reflections increases until they constitute a statistical clutter.

The reflected sound contributes to distance perception, and to the auditory spatial impression, which is composed of at least two components: apparent source width (ASW) (Another commonly used term for ASW is auditory spaciousness) and listener envelopment (LEV). ASW is defined as a broadening of the apparent width of a sound source and is primarily determined by early lateral reflections. LEV refers to the listener's sense of being enveloped by sound and is determined primarily by late-arriving reflections. The goal of electroacoustic stereophonic sound reproduction is to evoke the perception of a pleasing auditory spatial image. This can have a natural or architectural reference (e.g. the recording of a concert in a hall), or it may be a sound field that is not existent in reality (e.g. electroacoustic music).

From the field of concert hall acoustics, it is well known that—to obtain a subjectively pleasing sound field—a strong sense of auditory spatial impression is important, with LEV being an integral part. The ability of loudspeaker setups to reproduce an enveloping sound field by means of reproducing a diffuse sound field is of interest. In a synthetic sound field it is not possible to reproduce all naturally occurring reflections using dedicated transducers. That is especially true for diffuse later reflections. The timing and level properties of diffuse reflections can be simulated by using "reverberated" signals as loudspeakers feeds. If those are sufficiently uncorrelated, the number and location of the loudspeakers used for playback determines if the sound field is perceived as being diffuse. The goal is to evoke the perception of a continuous, diffuse sound field using only a discrete number of transducers. That is, creating sound fields where no direction of sound arrival can be estimated and especially no single transducer can be localized. The subjective diffuseness of synthetic sound fields can be evaluated in subjective tests.

Stereophonic sound reproductions aim at evoking the perception of a continuous sound field using only a discrete number of transducers. The features desired the most are directional stability of localized sources and realistic rendering of the surrounding auditory environment. The majority of formats used today to store or transport stereophonic recordings are channel-based. Each channel conveys a signal that is intended to be played back over an associated loudspeaker at as specific position. A specific auditory image is designed during the recording or mixing process. This image is accurately recreated if the loudspeaker setup used for reproduction resembles the target setup that the recording was designed for.

The number of feasible transmission and playback channels constantly grows and with every emerging audio reproduction format comes the desire to render legacy format content over the actual playback system. Upmix algorithms are a solution to this desire, computing a signal with more channels from a legacy signal. A number of stereo upmix algorithms have been proposed in the literature, e.g. Carlos Avendano and Jean-Marc Jot, "A frequency-domain approach to multichannel upmix", *Journal of the Audio Engineering Society*, vol. 52, no. 7/8, pp. 740-749, 2004; Christof Faller, "Multiple-loudspeaker playback of stereo signals," *Journal of the Audio Engineering Society*, vol. 54, no. 11, pp. 1051-1064, November 2006; John Usherand Jacob Benesty, "Enhancement of spatial sound quality: A new reverberation-extraction audio upmixer," *IEEE Transactions on Audio, Speech, and Language Processing*, vol. 15, no. 7, pp. 2141-2150, September 2007. Most of these algorithms are based on a direct/ambient signal decomposition followed by rendering adapted to the target loudspeaker setup.

The described direct/ambient signal decompositions are not readily applicable to multi-channel surround signals. It is not easy to formulate a signal model and filtering to obtain from N audio channels the corresponding N direct sound and N ambient sound channels. The simple signal model used in the stereo case, see e.g. Christof Faller, "Multiple-loudspeaker playback of stereo signals," *Journal of the Audio Engineering Society*, vol. 54, no. 11, pp. 1051-1064, November 2006, assuming direct sound to be correlated amongst all channels, does not capture the diversity of channel relations that can exist between surround signal channels.

The general goal of stereophonic sound reproduction is to evoke the perception of a continuous sound field using only a limited number of transmission channels and transducers. Two loudspeakers are the minimum requirement for spatial sound reproduction. Modern consumer systems often offer a larger number of reproduction channels. Basically, stereophonic signals (independent of the number of channels) are recorded or mixed such that for each source the direct sound goes coherent (=dependent) into a number of channels with specific directional cues and reflected independent sounds go into a number of channels determining cues for apparent source width and listener envelopment. Correct perception of the intended auditory image is usually only possible in the ideal point of observation in the playback setup the recording was intended for. Adding more speakers to a given loudspeaker setup usually enables a more realistic reconstruction/simulation of a natural sound field. To use the full advantage of an extended loudspeaker setup if the input signals are given in another format, or to manipulate the perceptually distinct parts of the input signal, those have to be separately accessible. This specification describes a method to separate the dependent and independent components of stereophonic recordings comprising an arbitrary number of input channels below.

A decomposition of audio signals into perceptually distinct components is necessitated for high quality signal modification, enhancement, adaptive playback, and perceptual coding. A number of methods have recently been proposed that allow the manipulation and/or extraction of perceptually distinct signal components from two-channel input signals. Since input signals with more than two channels become more and more common, the described manipulations are desirable also for multichannel input signals. However, most of the concepts described for two-channel input can not easily be extended to work with input signals with an arbitrary number of channels.

If one were to perform a signal analysis into direct and ambience parts with, for example, a 5.1 channel surround signal having a left channel, a center channel, a right channel, a left surround channel, a right surround channel and a low-frequency enhancement (subwoofer), it is not straight-forward how one should apply a direct/ambience signal analysis. One might think of comparing each pair of the six channels resulting in a hierarchical processing which has, in the end, up to 15 different comparison operations. Then, when all of these 15 comparison operations have been done, where each channel has been compared to every other channel, one would have to determine how one should evaluate the 15 results. This is time consuming, the results are hard to interprete, and due to the considerable amount of processing resources, not usable for e.g. real-time applications of direct/ambience separation or, generally, signal decompositions which may be, for example, used in the context of upmix or any other audio processing operations.

In M. M. Goodwin and J. M. Jot, "Primary-ambient signal decomposition and vector-based localization for spatial audio coding and enhancement," in *Proc. Of ICASSP* 2007, 2007, a principal component analysis is applied to the input channel signals to perform the primary (=direct) and ambient signal decomposition.

The models used in Christof Faller, "Multiple-loudspeaker playback of stereo signals," *Journal of the Audio Engineering Society*, vol. 54, no. 11, pp. 1051-1064, November 2006 and C. Faller, "A highly directive 2-capsule based microphone system," in *Preprint* 123$^{rd}$ *Conv. Aud. Eng. Soc., Oct.* 2007 assume de-correlated or partially correlated diffuse sound in stereo and microphone signals, respectively. They derive filters for extracting diffuse/ambient signal given this assumption. These approaches are limited to single and two channel audio signals.

A further reference is C. Avendano and J.-M. Jot, "A frequency-domain approach to multichannel upmix", Journal of the Audio Engineering Society, vol. 52, no. 7/8, pp. 740-749, 2004. The reference M. M. Goodwin and J. M. Jot, "Primary-ambient signal decomposition and vector-based localization for spatial audio coding and enhancement," in *Proc. Of ICASSP* 2007, 2007, comments on the Avendano, Jot reference as follows. The reference provides an approach which involves creating a time-frequency mask to extract the ambience from a stereo input signal. The mask is based on the cross-correlation between the left- and right channel signals, however, so this approach is not immediately applicable to the problem of extracting ambience from an arbitrary multichannel input. To use any such correlation-based method in this higher-order case would call for a hierarchical pairwise correlation analysis, which would entail a significant computational cost, or some alternate measure of multichannel correlation.

Spatial Impulse Response Rendering (SIRR) (Juha Merimaa and Ville Pulkki, "Spatial impulse response rendering", in *Proc. of the* 7$^{th}$ *Int. Conf. on Digital Audio Effects* (DAFx'04), 2004) estimates the direct sound with direction and diffuse sound in B-Format impulse responses. Very similar to SIRR, Directional Audio Coding (DirAC) (Ville Pulkki, "Spatial sound reproduction with directional audio coding," *Journal of the Audio Engineering Society*, vol. 55, no. 6, pp. 503-516, June 2007) implements similar direct and diffuse sound analysis to B-Format continuous audio signals.

The approach presented in Julia Jakka, *Binaural to Multichannel Audio Upmix*, Ph.D. thesis, Master's Thesis, Helsinki University of Technology, 2005 describes an upmix using binaural signals as input.

The reference Boaz Rafaely, "Spatially Optimal Wiener Filtering in a Reverberant Sound Field, IEEE Workshop on Applications of Signal Processing to Audio and Acoustics 2001, Oct. 21 to 24, 2001, New Paltz, N.Y.," describes the derivation of Wiener filters which are spatially optimal for reverberant sound fields. An application to two-microphone noise cancellation in reverberant rooms is given. The optimal filters which are derived from the spatial correlation of diffuse sound fields capture the local behavior of the sound fields and are therefore of lower order and potentially more spatially robust than conventional adaptive noise cancellation filters in reverberant rooms. Formulations for unconstrained and causally constrained optimal filters are presented and an example application to a two-microphone speech enhancement is demonstrated using a computer simulation.

While the Wiener-filtering approach can provide useful results for noise cancellation in reverberant rooms, it can be computationally inefficient and it is, for some instances, not so useful for signal decomposition.

SUMMARY

According to an embodiment, an apparatus for decomposing a signal having a plurality of channels may have: an analyzer for analyzing a similarity between two channels of an analysis signal related to the signal having the plurality of channels to obtain an analysis result, wherein the analyzer is configured for using a pre-calculated frequency-dependent similarity curve as a reference curve to determine the analysis result, wherein the pre-calculated frequency-dependent similarity curve has been calculated based on two signals to obtain a quantitative degree of similarity between the two signals over a frequency range; and a signal processor for processing the analysis signal or a signal derived from the analysis signal or a signal, from which the analysis signal is derived, using the analysis result to obtain a decomposed signal.

According to another embodiment, a method of decomposing a signal having a plurality of channels may have the steps of: analyzing a similarity between two channels of an analysis signal related to the signal having the plurality of channels using a pre-calculated frequency-dependent similarity curve as a reference curve to determine an analysis result, wherein the pre-calculated frequency-dependent similarity curve has been calculated based on two signals to obtain a quantitative degree of similarity between the two signals over a frequency range; and processing the analysis signal or a signal derived from the analysis signal or a signal, from which the analysis signal is derived, using the analysis result to obtain a decomposed signal.

Another embodiment may have a computer program for performing the inventive method, when the computer program is executed by a computer or processor.

The present invention is based on the finding that a particular efficiency for the purpose of signal decomposition is obtained when the signal analysis is performed based on the pre-calculated frequency-dependent similarity curve as a reference curve. The term similarity includes the correlation and the coherence, where—in a strict—mathematical sense, the correlation is calculated between two signals without an additional time shift and the coherence is calculated by shifting the two signals in time/phase so that the signals have a maximum correlation and the actual correlation over frequency is then calculated with the time/phase shift applied. For this text, similarity, correlation and coherence are considered to mean the same, i.e., a quantitative degree of similarity between two signals, e.g., where a higher absolute value of the similarity means that the two signals are more similar and a lower absolute value of the similarity means that the two signals are less similar.

It has been shown that the usage of such a similarity curve as a reference curve allows a very efficiently implementable analysis, since the curve can be used for straightforward comparison operations and/or weighting factor calculations. The use of a pre-calculated frequency-dependent similarity curve allows to only perform simple calculations rather than more complex Wiener filtering operations. Furthermore, the application of the frequency-dependent similarity curve is particularly useful due to the fact that the problem is not addressed from a statistical point of view but is addressed in a more analytic way, since as much information as possible from the current setup is introduced so as to obtain a solution to the problem. Additionally, the flexibility of this procedure is very high, since the reference curve can be obtained by many different ways. One way is to actually measure the two or more signals in a certain setup and to then calculate the similarity curve over frequency from the measured signals. Therefore, one may emit independent signals from different speakers or signals having a certain degree of dependency which is pre-known.

The other alternative is to simply calculate the similarity curve under the assumption of independent signals. In this case, any signals are actually not necessitated, since the result is signal-independent.

The signal decomposition using a reference curve for the signal analysis can be applied for stereo processing, i.e., for decomposing a stereo signal. Alternatively, this procedure can also be implemented together with a downmixer for decomposing multichannel signals. Alternatively, this procedure can also be implemented for multichannel signals without using a downmixer when a pair-wise evaluation of signals in a hierarchical way is envisaged.

In a further embodiment it is an advantageous approach to not perform the analysis with respect to the different signal components with the input signal directly, i.e. with a signal having at least three input channels. Instead, the multichannel input signal having at least three input channels is processed by a downmixer for downmixing the input signal to obtain a downmixed signal. The downmixed signal has a number of downmix channels which is smaller than the number of input channels and, advantageously, is two. Then, the analysis of the input signal is performed on the downmixed signal rather than on the input signal directly and the analysis results in an analysis result. However, this analysis result is not applied to the downmixed signal, but is applied to the input signal or, alternatively, to a signal derived from the input signal where this signal derived from the input signal may be an upmix signal or, depending on the number of channels of the input signals, also a downmix signal, but this signal derived from the input signal will be different from the downmixed signal, on which the analysis has been performed. When, for example, the case is considered that the input signal is a 5.1 channel signal, then the downmix signal, on which the analysis is performed, might be a stereo downmix having two channels. The analysis results are then applied to the 5.1 input signal directly, to a higher upmix such as a 7.1 output signal or to a multi-channel downmix of the input signal having for example only three channels, which are the left channel, the center channel and the right channel, when only a three channel audio rendering apparatus is at hand. In any case, however, the signal on which the analysis results are applied by the signal processor is different from the downmixed signal that the analysis has been performed on and typically has more channels than the downmixed signal, on which the analysis with respect to the signal components is performed on.

The so-called "indirect" analysis/processing is possible due to the fact that one can assume that any signal components in the individual input channels also occur in the downmixed channels, since a downmix typically consists of an addition of input channels in different ways. One straightforward downmix is, for example, that the individual input channels are weighted as necessitated by a downmix rule or a downmix matrix and are then added together after having been weighted. An alternative downmix consists of filtering the input channels with certain filters such as HRTF filters and the downmix is performed by using filtered signals, i.e. the signals filtered by HRTF filters as known in the art. For a five channel input signal one necessitates 10 HRTF filters, and the HRTF filter outputs for the left part/left ear are added together and the HRTF filter outputs for the right channel filters are added together for the right ear. Alternative downmixes can be applied in order to reduce the number of channels which have to be processed in the signal analyzer.

Hence, embodiments of the present invention describe a novel concept to extract perceptually distinct components from arbitrary input signals by considering an analysis signal, while the result of the analysis is applied to the input signal. Such an analysis signal can be gained e.g. by considering a propagation model of the channels or loudspeaker signals to the ears. This is in part motivated by the fact that the human auditory system also uses solely two sensors (the left and right ear) to evaluate sound fields. Thus, the extraction of perceptually distinct components is basically reduced to the consideration of an analysis signal that will be denoted as downmix in the following. Throughout this document, the term downmix is used for any preprocessing of the multichannel signal resulting in an analysis signal (this may include e.g. a propagation model, HRTFs, BRIRs, simple cross-factor downmix).

Knowing the format of the given input and the desired characteristics of the signal to be extracted, the ideal inter-channel relations can be defined for the downmixed format and such, an analysis of this analysis signal is sufficient to generate a weighting mask (or multiple weighting masks) for the decomposition of multichannel signals.

In an embodiment, the multi-channel problem is simplified by using a stereo downmix of a surround signal and applying a direct/ambient analysis to the downmix. Based on the result, i.e. short-time power spectra estimations of direct and ambient sounds, filters are derived for decomposing a N-channel signal to N direct sound and N ambient sound channels.

The present invention is advantageous due to the fact that signal analysis is applied on a smaller number of channels, which significantly reduces the processing time necessitated, so that the inventive concept can even be applied in real time applications for upmixing or downmixing or any other signal processing operation where different components such as perceptually different components of a signal are necessitated.

A further advantage of the present invention is that although a downmix is performed it has been found out that this does not deteriorate the detectability of perceptually distinct components in the input signal. Stated differently, even when input channels are downmixed, the individual signal components can nevertheless be separated to a large extent. Furthermore, the downmix operates as a kind of "collection" of all signal components of all input channels into two channels and the single analysis applied on these "collected" downmixed signals provides a unique result which no longer has to be interpreted and can be directly used for signal processing.

BRIEF DESCRIPTION OF THE DRAWINGS

Embodiments of the present invention will be detailed subsequently referring to the appended drawings, in which:

FIGS. 11A and 11B illustrate example equations for applying a signal analysis without a frequency-dependent correlation curve, but relying on Wiener filtering approach.

DETAILED DESCRIPTION OF THE INVENTION

Figure 1:
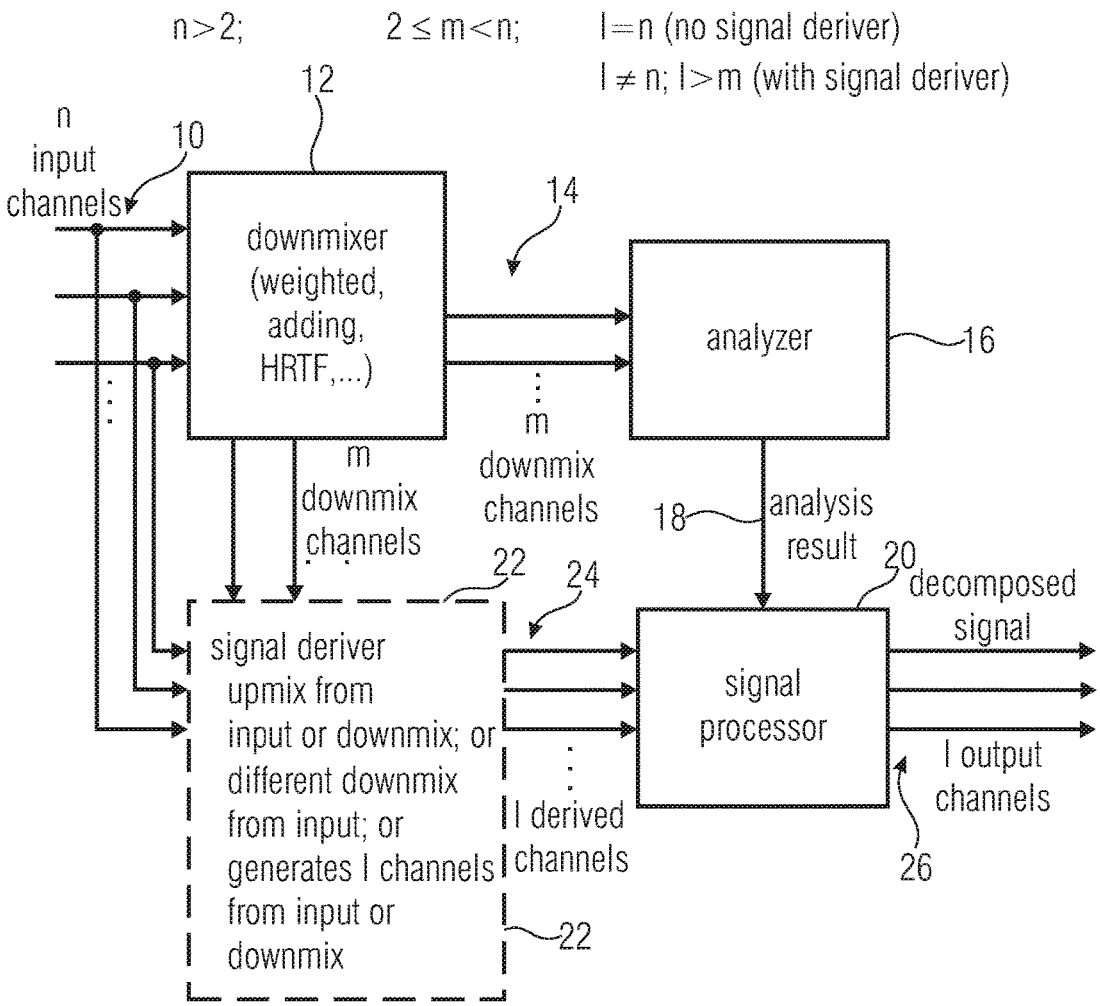
FIG. 1 is a block diagram for illustrating an apparatus for decomposing an input signal using a downmixer.

FIG. 1 illustrates an apparatus for decomposing an input signal 10 having a number of at least three input channels or, generally, N input channels. These input channels are input into a downmixer 12 for downmixing the input signal to obtain a downmixed signal 14, wherein the downmixer 12 is arranged for downmixing so that a number of downmix channels of the downmixed signal 14, which is indicated by "m", is at least two and smaller than the number of input channels of the input signal 10. The m downmix channels are input into an analyzer 16 for analyzing the downmixed signal to derive an analysis result 18. The analysis result 18 is input into a signal processor 20, where the signal processor is arranged for processing the input signal 10 or a signal derived from the input signal by a signal deriver 22 using the analysis result, wherein the signal processor 20 is configured for applying the analysis results to the input channels or to channels of the signal 24 derived from the input signal to obtain a decomposed signal 26.

In the embodiment illustrated in FIG. 1, a number of input channels is n, the number of downmix channels is m, the number of derived channels is 1, and the number of output channels is equal to 1, when the derived signal rather than the input signal is processed by the signal processor. Alternatively, when the signal deriver 22 does not exist then the input signal is directly processed by the signal processor and then the number of channels of the decomposed signal 26 indicated by "1" in FIG. 1 will be equal to n. Hence, FIG. 1 illustrates two different examples. One example does not have the signal deriver 22 and the input signal is directly applied to the signal processor 20. The other example is that the signal deriver 22 is implemented and, then, the derived signal 24 rather than the input signal 10 is processed by the signal processor 20. The signal deriver may, for example, be an audio channel mixer such as an upmixer for generating more output channels. In this case 1 would be greater than n. In another embodiment, the signal deriver could be another audio processor which performs weighting, delay or anything else to the input channels and in this case the number of output channels of 1 of the signal deriver 22 would be equal to the number n of input channels. In a further implementation, the signal deriver could be a downmixer which reduces the number of channels from the input signal to the derived signal. In this implementation, it is advantageous that the number 1 is still greater than the number m of downmixed channels in order to have one of the advantages of the present invention, i.e. that the signal analysis is applied to a smaller number of channel signals.

The analyzer is operative to analyze the downmixed signal with respect to perceptually distinct components. These perceptually distinct components can be independent components in the individual channels on the one hand, and dependent components on the other hand. Alternative signal components to be analyzed by the present invention are direct components on the one hand and ambient components on the other hand. There are many other components which can be separated by the present invention, such as speech components from music components, noise components from speech components, noise components from music components, high frequency noise components with respect to low frequency noise components, in multi-pitch signals the components provided by the different instruments, etc. This is due to the fact that there are powerful analysis tools such as Wiener filtering as discussed in the context of FIG. 11A, 11B or other analysis procedures such as using a frequency-dependent correlation curve as discussed in the context of, for example, FIG. 8 in accordance with the present invention.

Figure 2:
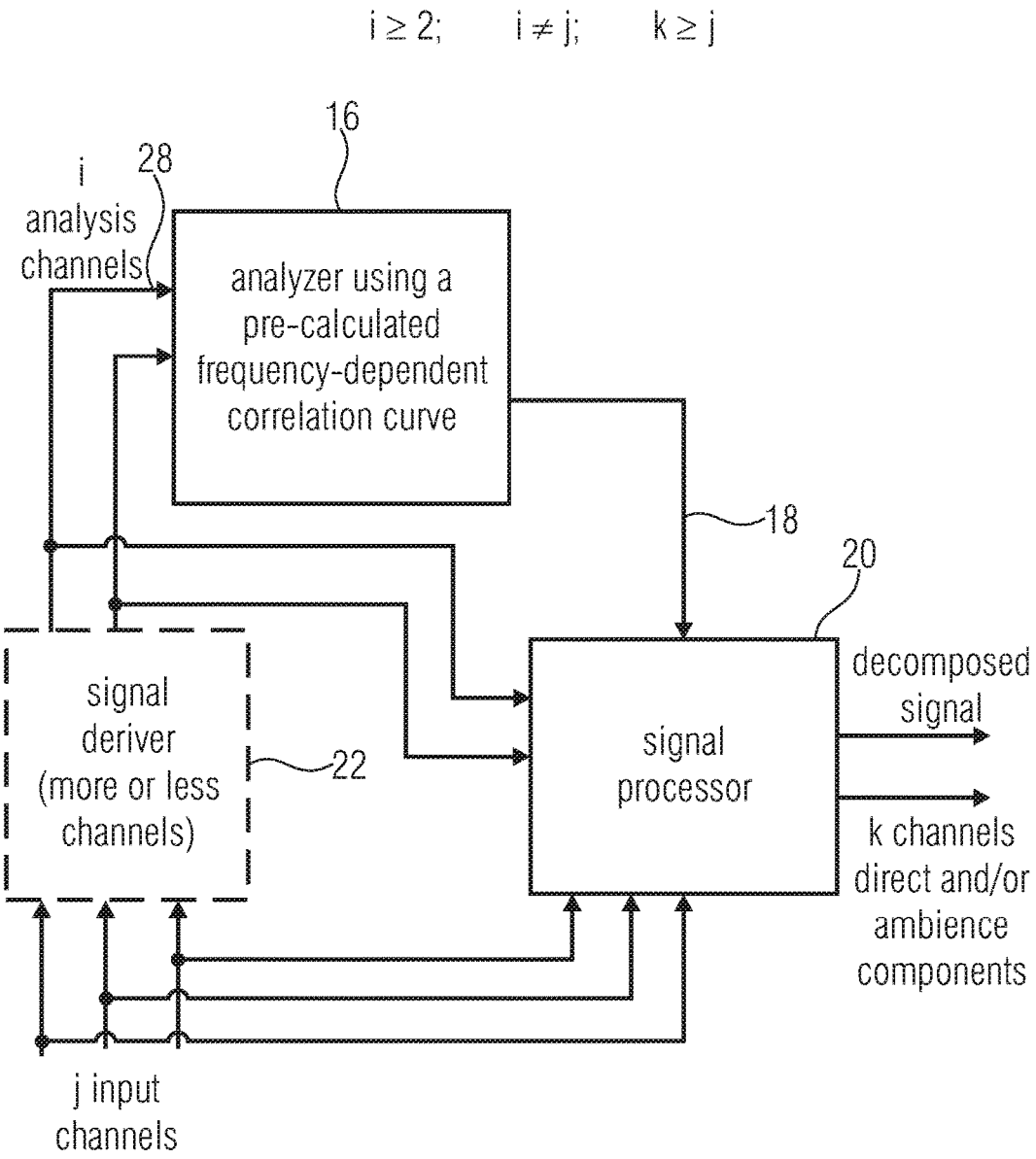
FIG. 2 is a block diagram illustrating an implementation of an apparatus for decomposing a signal having a number of at least three input channels using an analyzer with a pre-calculated frequency dependent correlation curve in accordance with a further aspect of the invention.

FIG. 2 illustrates another aspect, where the analyzer is implemented for using a pre-calculated frequency-dependent correlation curve 16. Thus, the apparatus for decomposing a signal 28 having a plurality of channels comprises the analyzer 16 for analyzing a correlation between two channels of an analysis signal identical to the input signal or related to the input signal, for example, by a downmixing operation as illustrated in the context of FIG. 1. The analysis signal analyzed by the analyzer 16 has at least two analysis channels, and the analyzer 16 is configured for using a pre-calculated frequency dependent correlation curve as a reference curve to determine the analysis result 18. The signal processor 20 can operate in the same way as discussed in the context of FIG. 1 and is configured for processing the analysis signal or a signal derived from the analysis signal by a signal deriver 22, where the signal deriver 22 can be implemented similarly to what has been discussed in the context of the signal deriver 22 of FIG. 1. Alternatively, the signal processor can process a signal, from which the analysis signal is derived and the signal processing uses the analysis result to obtain a decomposed signal. Hence, in the embodiment of FIG. 2 the input signal can be identical to the analysis signal and, in this case, the analysis signal can also be a stereo signal having just two channels as illustrated in FIG. 2. Alternatively, the analysis signal can be derived from an input signal by any kind of processing, such as downmixing as described in the context of FIG. 1 or by any other processing such as upmixing or so. Additionally, the signal processor 20 can be useful to apply the signal processing to the same signal as has been input into the analyzer or the signal processor can apply a signal processing to a signal, from which the analysis signal has been derived such as indicated in the context of FIG. 1, or the signal processor can apply a signal processing to a signal which has been derived from the analysis signal such as by upmixing or so.

Hence, different possibilities exist for the signal processor and all of these possibilities are advantageous due to the unique operation of the analyzer using a pre-calculated frequency-dependent correlation curve as a reference curve to determine the analysis result.

Subsequently, further embodiments are discussed. It is to be noted that, as discussed in the context of FIG. 2, even the use of a two-channel analysis signal (without a downmix) is considered. Hence, the present invention as discussed in the different aspects in the context of FIG. 1 and FIG. 2, which can be used together or as separate aspects, the downmix can be processed by the analyzer or a two-channel signal, which has probably not been generated by a downmix, can be processed by the signal analyzer using the pre-calculated reference curve. In this context, it is to be noted that the subsequent description of implementation aspects can be applied to both aspects schematically illustrated in FIG. 1 and FIG. 2 even when certain features are only described for one aspect rather than both. If, for example, FIG. 3 is considered, it becomes clear that the frequency-domain features of FIG. 3 are described in the context of the aspect illustrated in FIG. 1, but it is clear that a time/frequency transform as subsequently described with respect to FIG. 3 and the inverse transform can also be applied to the implementation in FIG. 2, which does not have a downmixer, but which has a specified analyzer that uses a pre-calculated frequency dependent correlation curve.

Particularly, the time/frequency converter would be placed to convert the analysis signal before the analysis signal is input into the analyzer, and the frequency/time converter would be placed at the output of the signal processor to convert the processed signal back into the time domain. When a signal deriver exists, the time/frequency converter might be placed at an input of the signal deriver so that the signal deriver, the analyzer, and the signal processor all operate in the frequency/subband domain. In this context, frequency and subband basically mean a portion in frequency of a frequency representation.

It is furthermore clear that the analyzer in FIG. 1 can be implemented in many different ways, but this analyzer is also, in one embodiment, implemented as the analyzer discussed in FIG. 2, i.e. as an analyzer which uses a pre-calculated frequency-dependent correlation curve as an alternative to Wiener filtering or any other analysis method.

Figure 3:
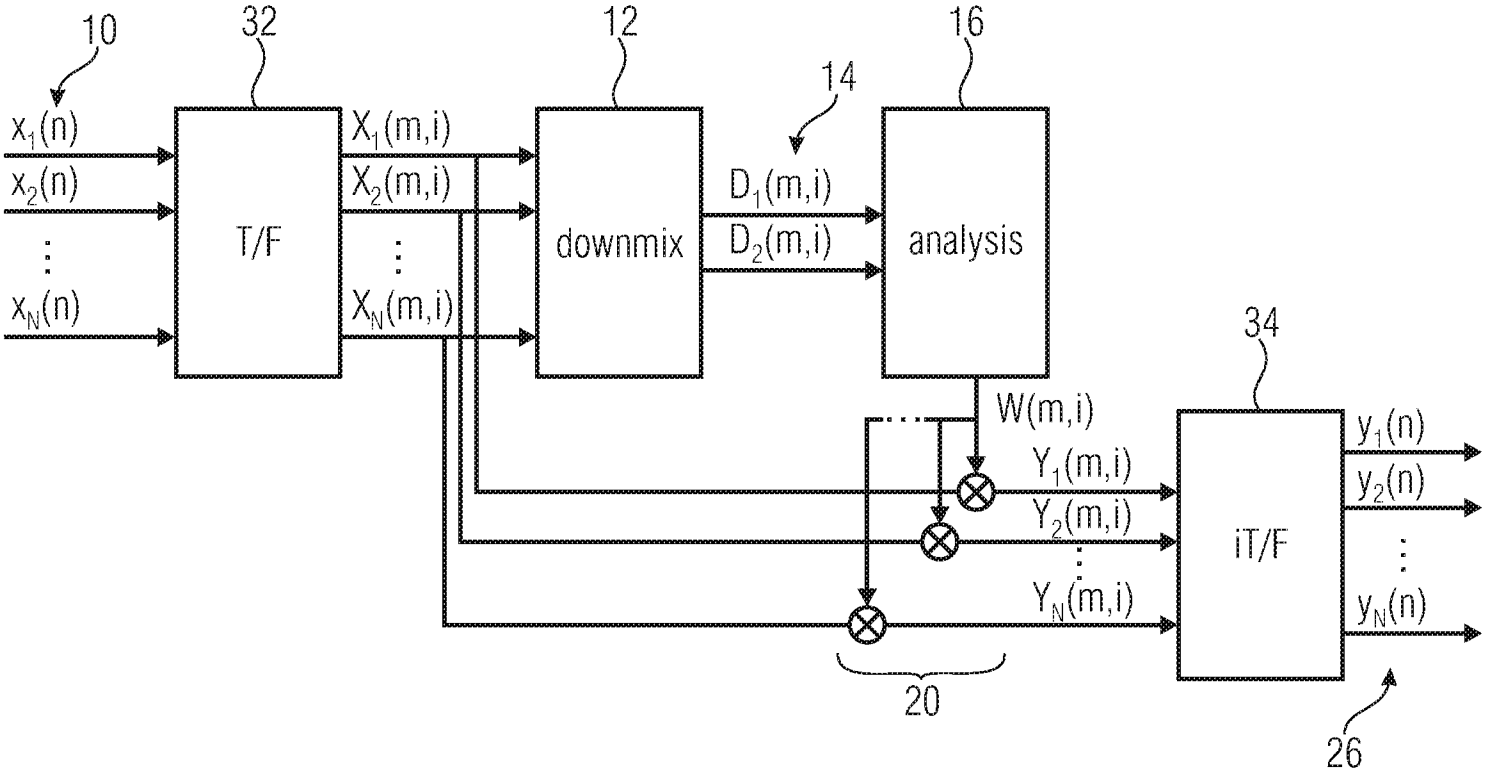
FIG. 3 illustrates a further implementation of the present invention with a frequency-domain processing for the downmix, analysis and the signal processing.

The embodiment of FIG. 3 applies a downmix procedure to an arbitrary input signal to obtain a two-channel representation. An analysis in the time-frequency domain is performed and weighting masks are calculated that are multiplied with the time frequency representation of the input signal, as is illustrated in FIG. 3.

In the picture, T/F denotes a time frequency transform; commonly a Short-time Fourier Transform (STFT). iT/F denotes the respective inverse transform. $[x_1(n), \ldots, x_N(n)]$ are the time domain input signals, where n is the time index. $[X_1(m,i), \ldots, X_N(m,i)]$ denote the coefficients of the frequency decomposition, where m is the decomposition time index, and i is the decomposition frequency index. $[D_1(m,i), D_2(m,i)]$ are the two channels of the downmixed signal.

$$\begin{pmatrix} D_1(m,i) \\ D_2(m,i) \end{pmatrix} = \begin{pmatrix} H_{11}(i) & H_{12}(i) & \cdots & H_{1N}(i) \\ H_{21}(i) & H_{22}(i) & \cdots & H_{2N}(i) \end{pmatrix} \begin{pmatrix} X_1(m,i) \\ X_2(m,i) \\ \vdots \\ X_N(m,i) \end{pmatrix} \quad (1)$$

W (m,i) is the calculated weighting. $[Y_1(m,i), \ldots, Y_N(m,i)]$ are the weighted frequency decompositions of each channel. $H_{ij}(i)$ are the downmix coefficients, which can be real-valued or complex-valued and the coefficients can be constant in time or time-variant. Hence, the downmix coefficients can be just constants or filters such as HRTF filters, reverberation filters or similar filters.

$$Y_j(m,i)=W_j(m,i)\cdot X_j(m,i), \text{ where } j=(1,2, \ldots ,N) \quad (2)$$

In FIG. 3 the case of applying the same weighting to all channels is depicted.

$$Y_j(m,i)=W(m,i)\cdot X_j(m,i) \quad (3)$$

$[y_1(n), \ldots, y_N(n)]$ are the time-domain output signals comprising the extracted signal components. (The input signal may have an arbitrary number of channels (N), produced for an arbitrary target playback loudspeaker setup. The downmix may include HRTFs to obtain ear-input-signals, simulation of auditory filters, etc. The downmix may also be carried out in the time domain).

In an embodiment, the difference between a reference correlation (Throughout this text, the term correlation is used as synonym for inter-channel similarity and may thus also include evaluations of time shifts, for which usually the term coherence is used. Even if time-shifts are evaluated, the resulting value may have a sign. (Commonly, the coherence is defined as having only positive values) as a function of frequency ($c_{ref}(\omega)$), and the actual correlation of the downmixed input signal ($c_{sig}(\omega)$) is computed. Depending on the deviation of the actual curve from the reference curve, a weighting factor for each time-frequency tile is calculated, indicating if it comprises dependent or independent components. The obtained time-frequency weighting indicates the independent components and may already be applied to each channel of the input signal to yield a multichannel signal (number of channels equal to number of input channels) including independent parts that may be perceived as either distinct or diffuse.

The reference curve may be defined in different ways. Examples are:

- Ideal theoretical reference curve for an idealized two- or three-dimensional diffuse sound field composed of independent components.
- The ideal curve achievable with the reference target loudspeaker setup for the given input signal (e.g. Standard stereo setup with azimuth angles (±30°), or standard five channel setup according to ITU-R BS.775 with azimuth angles (0°, ±30°, ±110°))).
- The ideal curve for the actually present loudspeaker setup (the actual positions could be measured or known through user-input. The reference curve can be calculated assuming playback of independent signals over the given loudspeakers).
- The actual frequency-dependent short time power of each input channel may be incorporated in the calculation of the reference.

Figure 4:
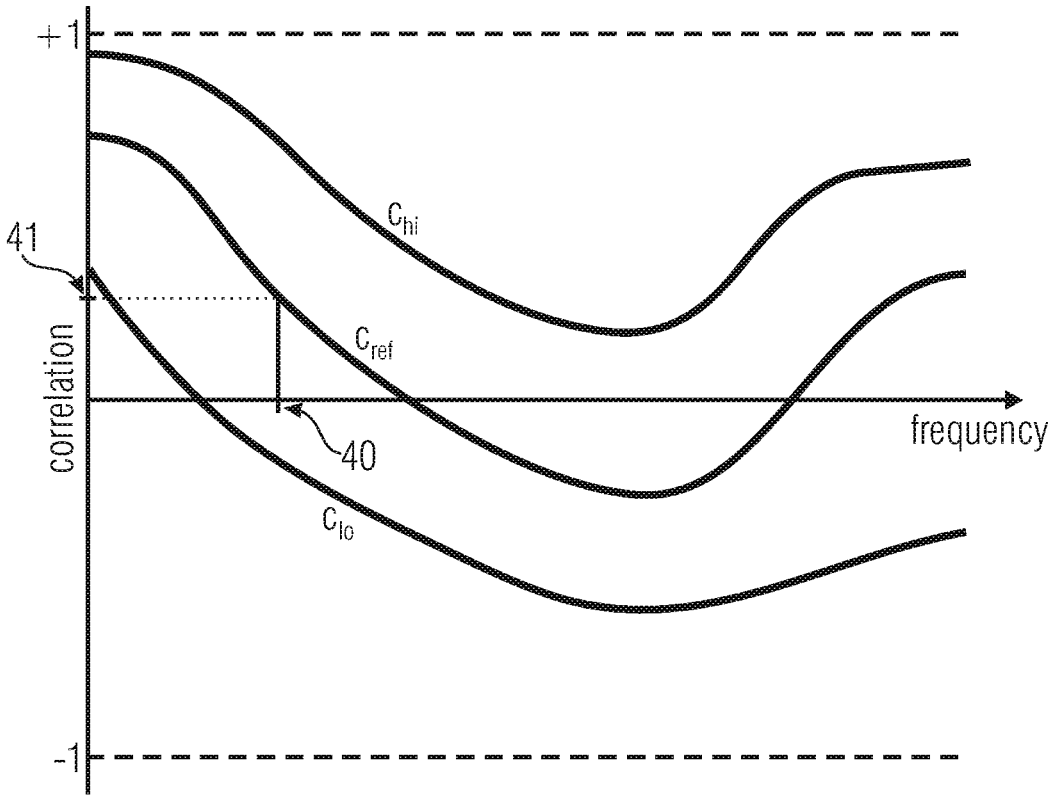
FIG. 4 illustrates an exemplary pre-calculated frequency dependent correlation curve for a reference curve for the analysis indicated in FIG. 1 or FIG. 2.

Given a frequency dependent reference curve ($c_{ref}(\omega)$), an upper threshold ($c_{hi}(\omega)$) and lower threshold ($c_{lo}(\omega)$) can be defined (see FIG. 4). The threshold curves may coincide with the reference curve ($c_{ref}(\omega)=c_{hi}(\omega)=c_{lo}(\omega)$), or be defined assuming detectability thresholds, or they may be heuristically derived.

If the deviation of the actual curve from the reference curve is within the boundaries given by the thresholds, the actual bin gets a weighting indicating independent components. Above the upper threshold or below the lower threshold, the bin is indicated as dependent. This indication may be binary, or gradually (i.e. following a soft-decision function). In particular, if the upper- and lower threshold coincides with the reference curve, the applied weighting is directly related to the deviation from the reference curve.

With reference to FIG. 3, reference numeral 32 illustrates a time/frequency converter which can be implemented as a short-time Fourier transform or as any kind of filterbank generating subband signals such as a QMF filterbank or so. Independent on the detailed implementation of the time/frequency converter 32, the output of the time/frequency converter is, for each input channel $x_i$ a spectrum for each time period of the input signal. Hence, the time/frequency processor 32 can be implemented to take a block of input samples of an individual channel signal and to calculate the frequency representation such as an FFT spectrum having spectral lines extending from a lower frequency to a higher frequency. Then, for a next block of time, the same procedure is performed so that, in the end, a sequence of short time spectra is calculated for each input channel signal. A certain frequency range of a certain spectrum relating to a certain block of input samples of an input channel is said to be a "time/frequency tile" and the analysis in analyzer 16 is performed based on these time/frequency tiles. Therefore, the analyzer receives, as an input for one time/frequency tile, the spectral value at a first frequency for a certain block of input samples of the first downmix channel $D_1$ and receives the value for the same frequency and the same block (in time) of the second downmix channel $D_2$.

Figure 8:
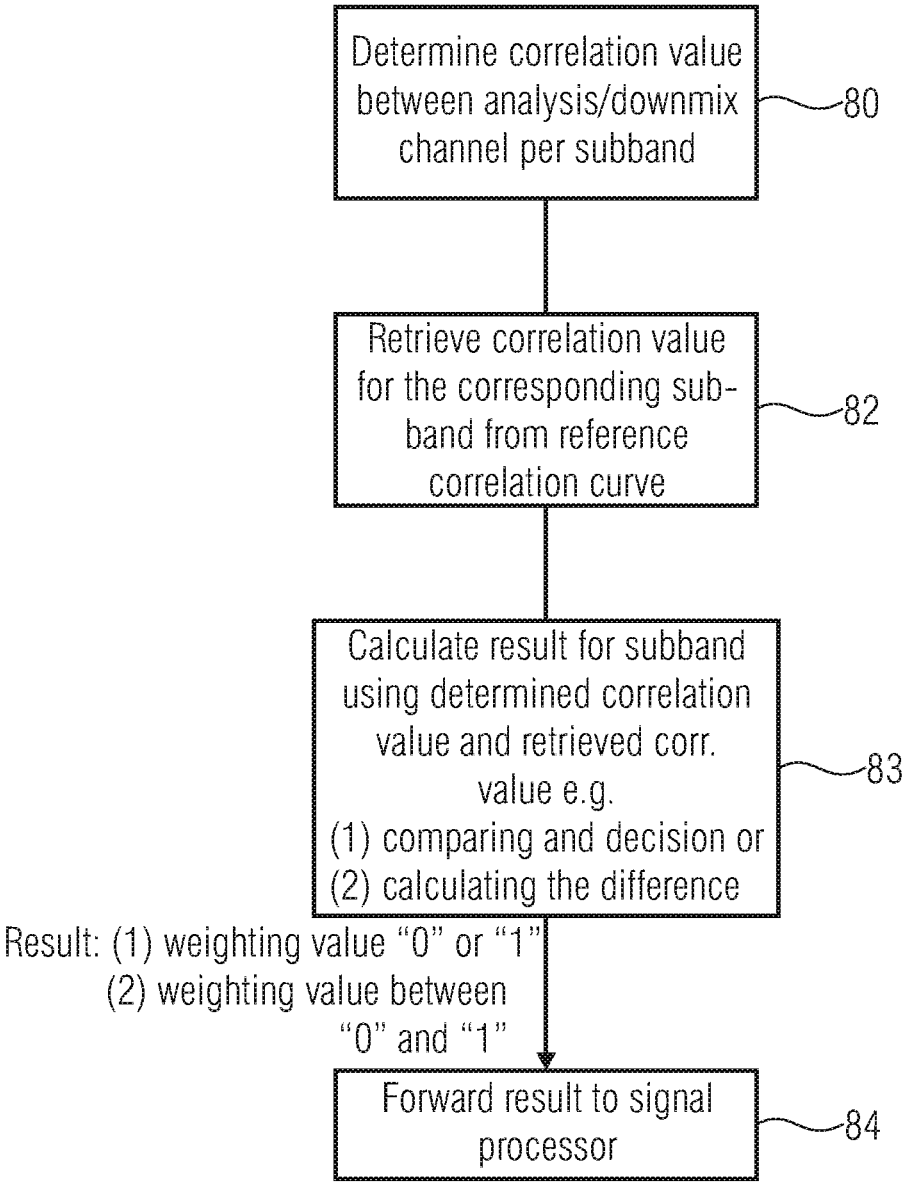
FIG. 8 illustrates a flowchart for indicating a way of processing in the signal analyzer of FIG. 1 or FIG. 2.
Figure 9A:
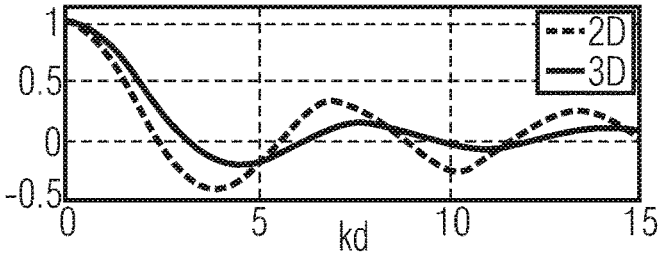
FIGS. 9*a*-9*e* illustrate different pre-calculated frequency dependent correlation curves which can be used as reference curves for several different setups with different numbers and positions of sound sources (such as loudspeakers)
Figure 9B:
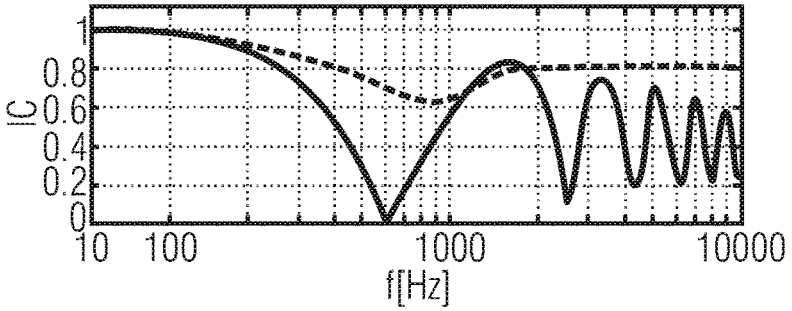
Figure 9C:
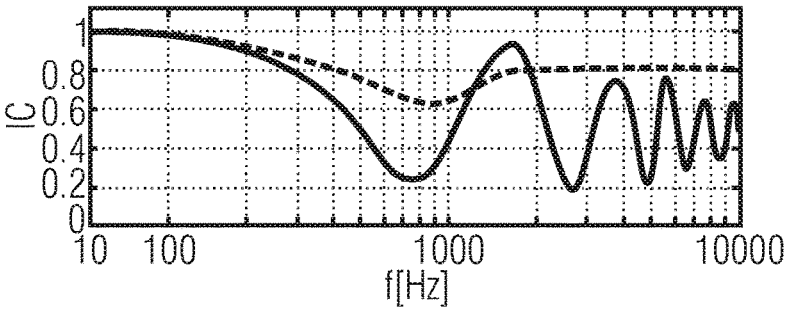
Figure 9D:
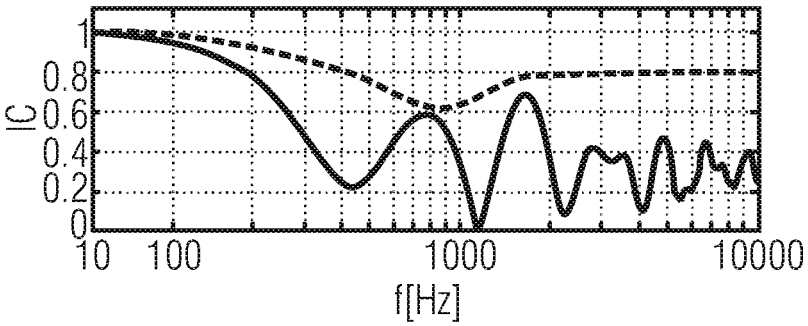
Figure 9E:
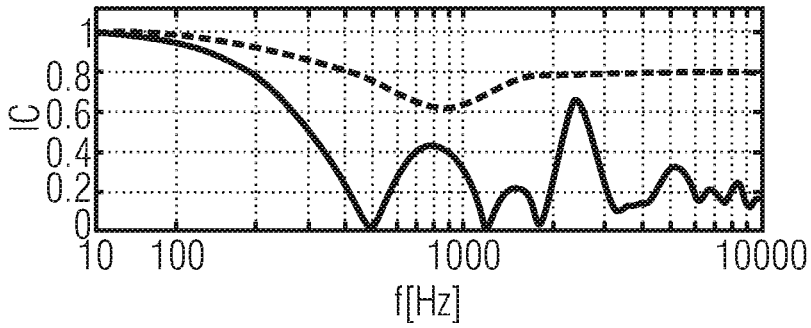

Then, as for example illustrated in FIG. 8, the analyzer 16 is configured for determining (80) a correlation value between the two input channels per subband and time block, i.e. a correlation value for a time/frequency tile. Then, the analyzer 16 retrieves, in the embodiment illustrated with respect to FIG. 2 or FIG. 4, a correlation value (82) for the corresponding subband from the reference correlation curve. When, for example, the subband is the subband indicated at 40 in FIG. 4, then the step 82 results in the value 41 indicating a correlation between −1 and +1, and value 41 is then the retrieved correlation value. Then, in step 83, the result for the subband using the determined correlation value from step 80 and the retrieved correlation value 41 obtained in step 82 is performed by performing a comparison and the subsequent decision or is done by calculating an actual difference. The result can be, as discussed before, a binary result saying that the actual time/frequency tile considered in the downmix/analysis signal has independent components. This decision will be taken, when the actually determined correlation value (in step 80) is equal to the reference correlation value or is quit close to the reference correlation value.

When, however, it is determined that the determined correlation value indicates a higher absolute correlation than the reference correlation value, then it is determined that the time/frequency tile under consideration comprises dependent components. Hence, when the correlation of a time/frequency tile of the downmix or analysis signal indicates a higher absolute correlation value than the reference curve, then it can be said that the components in this time/frequency tile are dependent on each other. When, however, the correlation is indicated to be very close to the reference curve, then it can be said that the components are independent. Dependent components can receive a first weighting value such as 1 and independent components can receive a second weighting value such as 0. Advantageously, as illustrated in FIG. 4, high and low thresholds which are spaced apart from the reference line are used in order to provide a better result which is more suited than using the reference curve alone.

Furthermore, with respect to FIG. 4, it is to be noted that the correlation can vary between −1 and +1. A correlation having a negative sign additionally indicates a phase shift of 180° between the signals. Therefore, other correlations only extending between 0 and 1 could be applied as well, in which the negative part of the correlation is simply made positive. In this procedure, one would then ignore a time shift or phase shift for the purpose of the correlation determination.

The alternative way of calculating the result is to actually calculate the distance between the correlation value determined in block 80 and the retrieved correlation value obtained in block 82 and to then determine a metric between 0 and 1 as a weighting factor based on the distance. While the first alternative (1) in FIG. 8 only results in values of 0 or 1, the possibility (2) results in values between 0 and 1 and are, in some implementations, advantageous.

The signal processor 20 in FIG. 3 is illustrated as multipliers and the analysis results are just a determined weighting factor which is forwarded from the analyzer to the signal processor as illustrated in 84 in FIG. 8 and is then applied to the corresponding time/frequency tile of the input signal 10. When for example the actually considered spectrum is the $20^{th}$ spectrum in the sequence of spectra and when the actually considered frequency bin is the $5^{th}$ frequency bin of this $20^{th}$ spectrum, then the time/frequency tile can be indicated as (20, 5) where the first number indicates the number of the block in time and the second number indicates the frequency bin in this spectrum. Then, the analysis result for time/frequency tile (20, 5) is applied to the corresponding time/frequency tile (20, 5) of each channel of the input signal in FIG. 3 or, when a signal deriver as illustrated in FIG. 1 is implemented, to the corresponding time/frequency tile of each channel of the derived signal.

Subsequently, the calculation of a reference curve is discussed in more detail. For the present invention, however, it is basically not important how the reference curve was derived. It can be an arbitrary curve or, for example, values in a look-up table indicating an ideal or desired relation of the input signals $x_j$ in the downmix signal D or, and in the context of FIG. 2 in the analysis signal. The following derivation is exemplary.

The physical diffusion of a sound field can be evaluated by a method introduced by Cook et al. (Richard K. Cook, R. V. Waterhouse, R. D. Berendt, Seymour Edelman, and Jr. M. C. Thompson, "Measurement of correlation coefficients in reverberant sound fields," *Journal Of The Acoustical Society Of America*, vol. 27, no. 6, pp. 1072-1077, November 1955), utilizing the correlation coefficient (r) of the steady state sound pressure of plane waves at two spatially separated points, as illustrated in the following equation (4)

$$r = \frac{\langle p_1(n) \cdot p_2(n) \rangle}{[\langle p_1^2(n) \rangle \cdot \langle p_2^2(n) \rangle]^{\frac{1}{2}}} \tag{4}$$

where $p_1(n)$ and $p_2(n)$ are the sound pressure measurements at two points, n is the time index, and <·> denotes time averaging. In a steady state sound field, the following relations can be derived:

$$r(k, d) = \frac{\sin(kd)}{kd} \text{(for three-dimensional sound fields), and} \tag{5}$$

$$r(k, d) = J_0(kd) \text{ (for two-dimensional soundfields),} \tag{6}$$

where d is the distance between the two measurement points and $$k = \frac{2\pi}{\lambda}$$

is the wavenumber, with λ being the wavelength. (The physical reference curve r(k,d) may already be used as $c_{ref}$ for further processing.)

A measure for the perceptual diffuseness of a sound field is the interaural cross correlation coefficient (ρ), measured in a sound field. Measuring ρ implies that the radius between the pressure sensors (resp. the ears) is fixed. Including this restriction, r becomes a function of frequency with the radian frequency ω=kc, where c is the speed of sound in air. Furthermore, the pressure signals differ from the previously considered free field signals due to reflection, diffraction, and bending-effects caused by the listener's pinnae, head, and torso. Those effects, substantial for spatial hearing, are described by head-related transfer functions (HRTFs). Considering those influences, the resulting pressure signals at the ear entrances are $p_L(n,\omega)$ and $p_R(n,\omega)$. For the calculation, measured HRTF data may be used or approximations can be obtained by using an analytical model (e.g. Richard O. Duda and William L. Martens, "Range dependence of the response of a spherical head model," *Journal Of The Acoustical Society Of America*, vol. 104, no. 5, pp. 3048-3058, November 1998).

Since the human auditory system acts as a frequency analyzer with limited frequency selectivity, furthermore this frequency selectivity may be incorporated. The auditory filters are assumed to behave like overlapping bandpass filters. In the following example explanation, a critical band approach is used to approximate these overlapping bandpasses by rectangular filters. The equivalent rectangular bandwidth (ERB) may be calculated as a function of center frequency (Brian R. Glasberg and Brian C. J. Moore, "Derivation of auditory filter shapes from notched-noise data," *Hearing Research*, vol. 47, pp. 103-138, 1990). Considering that the binaural processing follows the auditory filtering, p has to be calculated for separate frequency channels, yielding the following frequency dependent pressure signals $$p_{\hat{L}}(n, \omega) = \frac{1}{b(\omega)} \int_{\omega - \frac{b(\omega)}{2}}^{\omega + \frac{b(\omega)}{2}} p_L(n, \omega) d\omega \tag{7}$$

$$p_{\hat{R}}(n, \omega) = \frac{1}{b(\omega)} \int_{\omega - \frac{b(\omega)}{2}}^{\omega + \frac{b(\omega)}{2}} p_R(n, \omega) d\omega, \tag{8}$$

where the integration limits are given by the bounds of the critical band according to the actual center frequency ω. The factors 1/b (w) may or may not be used in equations (7) and (8).

If one of the sound pressure measurements is advanced or delayed by a frequency independent time difference, the coherence of the signals can be evaluated. The human auditory system is able to make use of such a time alignment property. Usually, the interaural coherence is calculated within ±1 ms. Depending on the available processing power, calculations can be implemented using only the lag-zero value (for low complexity) or the coherence with a time advance and delay (if high complexity is possible). In the following, no distinction is made between both cases.

The ideal behavior is achieved considering an ideal diffuse sound field, which can be idealized as a wave field that is composed of equally strong, uncorrelated plane waves propagating in all directions (i.e. a superposition of an infinite number of propagating plane waves with random phase relations and uniformly distributed directions of propagation). A signal radiated by a loudspeaker can be considered a plane wave for a listener positioned sufficiently far away. This plane wave assumption is common in stereophonic playback over loudspeakers. Thus, a synthetic sound field reproduced by loudspeakers consists of contributing plane waves from a limited number of directions.

Given an input signal with N channels, produced for playback over a setup with loudspeaker positions $[l_1, l_2, l_3, \ldots, l_N]$. (In the case of a horizontal only playback setup, indicates the azimuth angle. In the general case, $l_i$=(azimuth, elevation) indicates the position of the loudspeaker relative to the listener's head. If the setup present in the listening room differs from the reference setup, $l_i$ may alternatively represent the loudspeaker positions of the actual playback setup). With this information, an interaural coherence reference curve $\rho_{ref}$ for a diffuse field simulation can be calculated for this setup under the assumption that independent signals are fed to each loudspeaker. The signal power contributed by each input channel in each time-frequency tile may be included in the calculation of the reference curve. In the example implementation, $\rho_{ref}$ is used as $c_{ref}$.

Different reference curves as examples for frequency-dependent reference curves or correlation curves are illustrated in FIGS. 9*a* to 9*e* for a different number of sound sources at different positions of the sound sources and different head orientations as indicated in the Figs.

Subsequently the calculation of the analysis results as discussed in the context of FIG. 8 based on the reference curves is discussed in more detail.

The goal is to derive a weighting that equals 1, if the correlation of the downmix channels is equal to the calculated reference correlation under the assumption of independent signals being played back from all loudspeakers. If the correlation of the downmix equals +1 or −1, the derived weighting should be 0, indicating that no independent components are present. In between those extreme cases, the weighting should represent a reasonable transition between the indication as independent (W=1) or completely dependent (W=0).

Given the reference correlation curve $c_{ref}(\omega)$ and the estimation of the correlation/coherence of the actual input signal played back over the actual reproduction setup ($c_{sig}(\omega)$) ($c_{sig}$ is the correlation resp. coherence of the downmix), the deviation of $c_{sig}(\omega)$ from $c_{ref}(\omega)$ can be calculated. This deviation (possibly including an upper and lower threshold) is mapped to the range [0;1] to obtain a weighting (W(m,i)) that is applied to all input channels to separate the independent components.

The following example illustrates a possible mapping when the thresholds correspond with the reference curve:

The magnitude of the deviation (denoted as Δ) of the actual curve $c_{sig}$ from the reference $c_{ref}$ is given by $$\Delta(\omega)=|c_{sig}(\omega)-c_{ref}(\omega)| \tag{9}$$

Given that the correlation/coherence is bounded between [−1;+1], the maximally possible deviation towards +1 or −1 for each frequency is given by $$\overline{\Delta}_{+}(\omega)=1-c_{ref}(\omega) \tag{10}$$

$$\overline{\Delta}_{-}(\omega)=c_{ref}(\omega)+1 \tag{11}$$

The weighting for each frequency is thus obtained from $$W(\omega)=\begin{cases}1-\dfrac{\Delta(\omega)}{\overline{\Delta}_{+}(\omega)} & c_{sig}(\omega)\geq c_{ref}(\omega)\\ 1-\dfrac{\Delta(\omega)}{\overline{\Delta}_{-}(\omega)} & c_{sig}(\omega)<c_{ref}(\omega)\end{cases} \tag{13}$$

Considering the time dependence and the limited frequency resolution of the frequency decomposition, the weighting values are derived as follows (Here, the general case of a reference curve that may change over time is given. A time-independent reference curve (i.e. $c_{ref}(i)$) is also possible):

$$W(m,i)=\begin{cases}1-\dfrac{\Delta(m,i)}{\overline{\Delta}_{+}(m,i)} & c_{sig}(m,i)\geq c_{ref}(m,i),\\ 1-\dfrac{\Delta(m,i)}{\overline{\Delta}_{-}(m,i)} & c_{sig}(m,i)<c_{ref}(m,i)\end{cases} \tag{14}$$

Such a processing may be carried out in a frequency decomposition with frequency coefficients grouped to perceptually motivated subbands for reasons of computational complexity and to obtain filters with shorter impulse responses. Furthermore, smoothing filters could be applied and compression functions (i.e. distorting the weighting in a desired fashion, additionally introducing minimum and/or maximum weighting values) may be applied.

Figure 5:
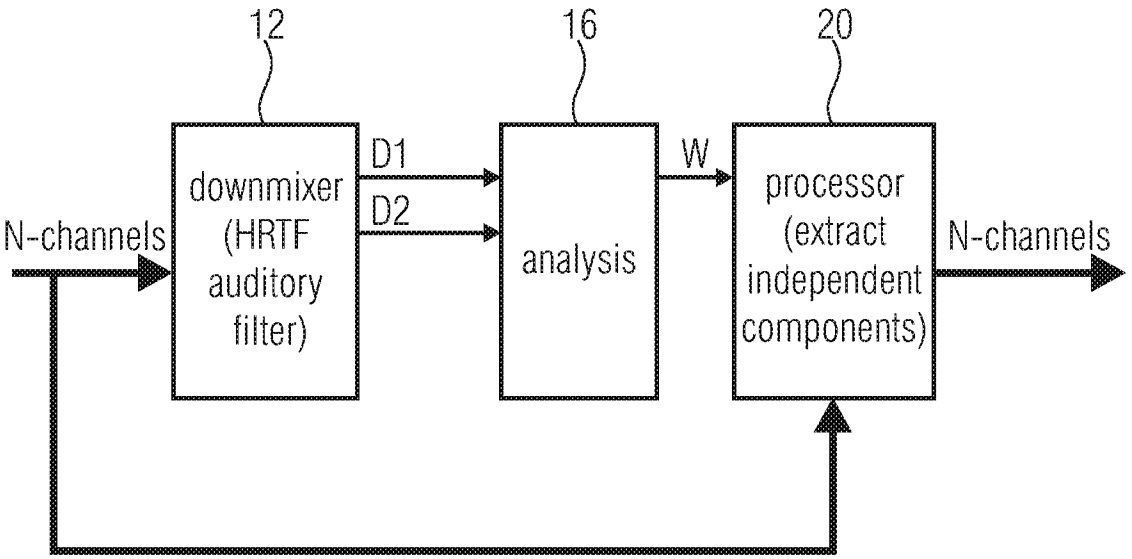
FIG. 5 illustrates a block diagram illustrating a further processing in order to extract independent components.

FIG. 5 illustrates a further implementation of the present invention, in which the downmixer is implemented using HRTF and auditory filters as illustrated. Furthermore, FIG. 5 additionally illustrates that the analysis results output by the analyzer 16 are the weighting factors for each time/frequency bin, and the signal processor 20 is illustrated as an extractor for extracting independent components. Then, the output of the processor 20 is, again, N channels, but each channel now only includes the independent components and does not include any more dependent components. In this implementation, the analyzer would calculate the weightings so that, in the first implementation of FIG. 8, an independent component would receive a weighting value of 1 and a dependent component would receive a weighting value of 0. Then, the time/frequency tiles in the original N channels processed by the processor 20 which have dependent components would be set to 0.

In the other alternative were there are weighting values between 0 and 1 in FIG. 8, the analyzer would calculate the weighting so that a time/frequency tile having a small distance to the reference curve would receive a high value (more close to 1), and a time/frequency tile having a large distance to the reference curve would receive a small weighting factor (being more close to 0). In the subsequent weighting illustrated, for example, in FIG. 3 at 20, the independent components would, then, be amplified while the dependent components would be attenuated.

When, however, the signal processor 20 would be implemented for not extracting the independent components, but for extracting the dependent components, then the weightings would be assigned in the opposite so that, when the weighting is performed in the multipliers 20 illustrated in FIG. 3, the independent components are attenuated and the dependent components are amplified. Hence, each signal processor can be applied for extracting of the signal components, since the determination of the actually extracted signal components is determined by the actual assigning of weighting values.

Figure 6:
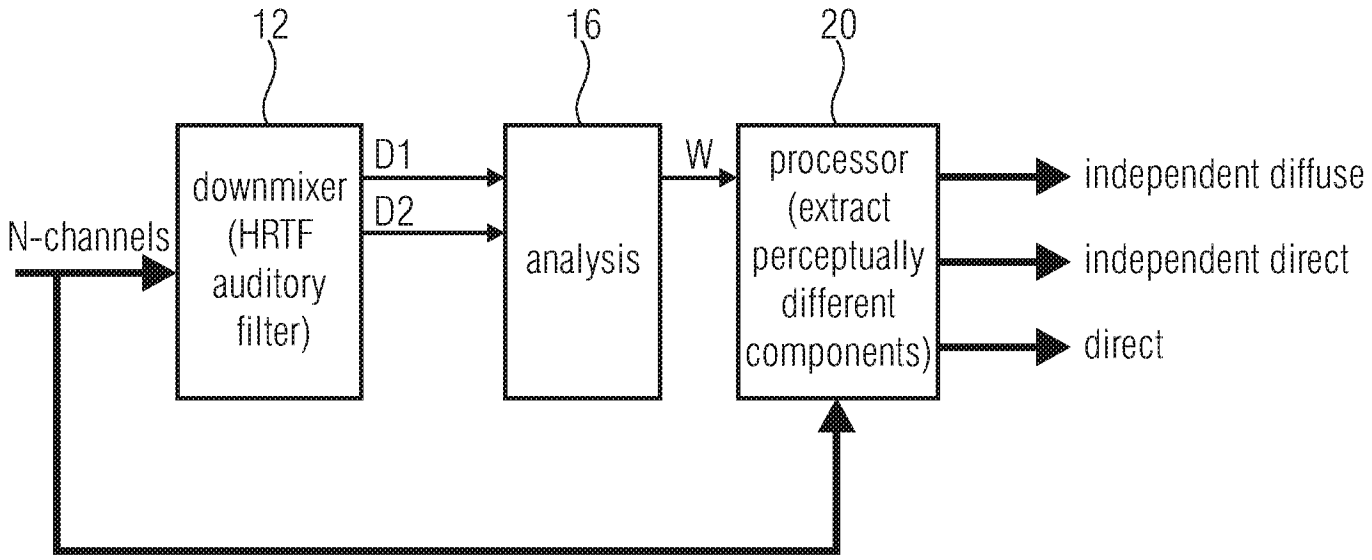
FIG. 6 illustrates a further implementation of a block diagram for further processing where independent diffuse, independent direct and direct components are extracted.

FIG. 6 illustrates a further implementation of the inventive concept, but now with a different implementation of the processor 20. In the FIG. 6 embodiment, the processor 20 is implemented for extracting independent diffuse parts, independent direct parts and direct parts/components per se.

To obtain, from the separated independent components ($Y_1, \ldots, Y_N$), the parts contributing to the perception of an enveloping/ambient sound field, further constraints have to be considered. One such constraint may be the assumption that enveloping ambience sound is equally strong from each direction. Thus, e.g. the minimum energy of each time-frequency tile in every channel of the independent sound signals can be extracted to obtain an enveloping ambient signal (which can be further processed to obtain a higher number of ambience channels). Example:

$$\tilde{Y}_j(m,i)=g_j(m,i)\cdot Y_j(m,i),\ \text{with}\ g_j(m,i)=\sqrt{\frac{\min\limits_{1\leq k\leq N}\{P_{Y_k}(m,i)\}}{P_{Y_j}(m,i)}}, \tag{15}$$

where P denotes a short-time power estimate. (This example shows the simplest case. One obvious exceptional case, where it is not applicable is when one of the channels includes signal pauses during which the power in this channel would be very low or zero.)

In some cases it is advantageous to extract the equal energy parts of all input channels and calculate the weighting using only this extracted spectra.

$$\tilde{X}_j(m, i) = g_j(m, i) \cdot X_j(m, i), \text{ with } g_j(m, i) = \sqrt{\frac{\min_{1 \le k \le N} \{P_{X_k}(m, i)\}}{P_{X_j}(m, i)}}, \quad (16)$$

The extracted dependent (those can e.g. be derived as $Y_{dependent}=Y_j(m,i)-X_j(m,i)$ parts) can be used to detect channel dependencies and such estimate the directional cues inherent in the input signal, allowing for further processes as e.g. repanning.

Figure 7:
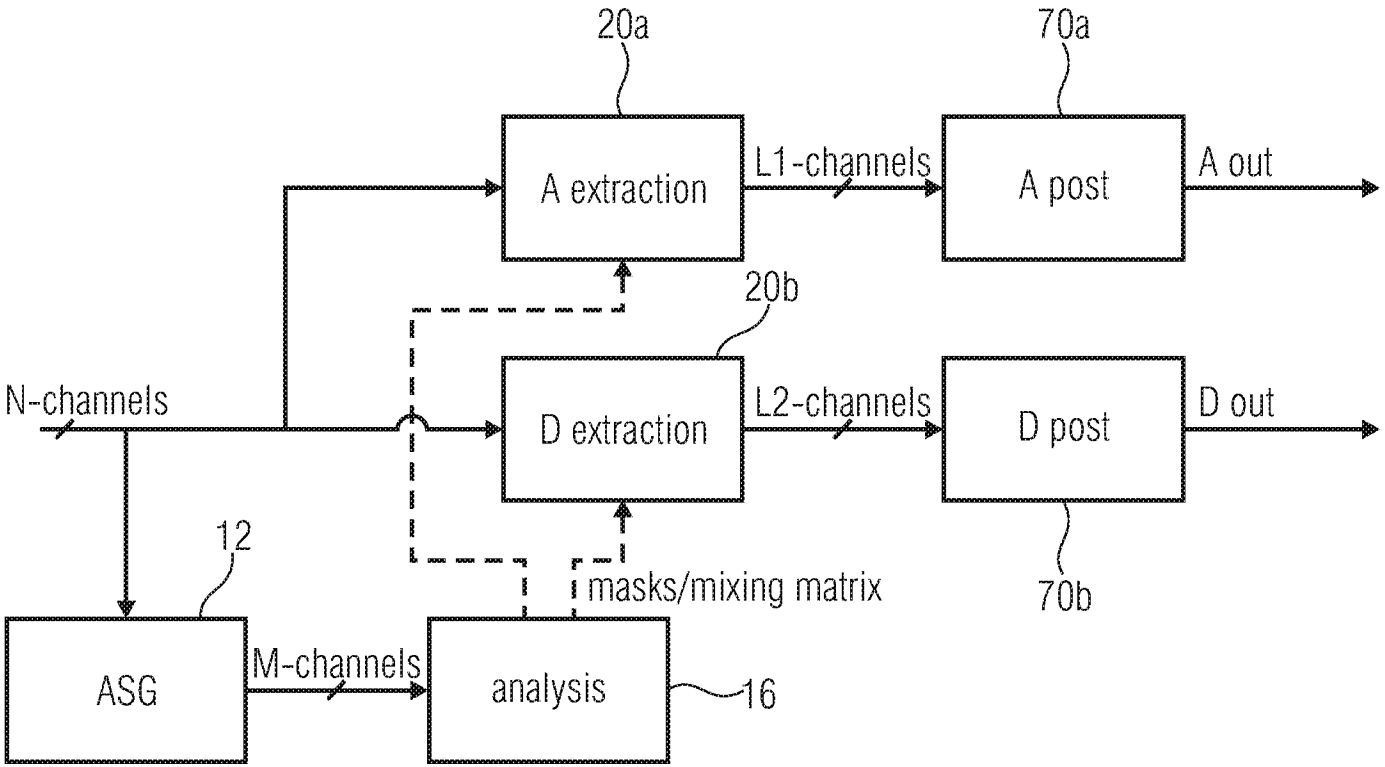
FIG. 7 illustrates a block diagram implementing the downmixer as an analysis signal generator.

FIG. 7 depicts a variant of the general concept. The N-channel input signal is fed to an analysis signal generator (ASG). The generation of the M-channel analysis signal may e.g. include a propagation model from the channels/loudspeakers to the ears or other methods denoted as downmix throughout this document. The indication of the distinct components is based on the analysis signal. The masks indicating the different components are applied to the input signals (A extraction/D extraction (20*a*, 20*b*)). The weighted input signals can be further processed (A post/D post (70*a*, 70*b*) to yield output signals with specific character, where in this example the designators "A" and "D" have been chosen to indicate that the components to be extracted may be "Ambience" and "Direct Sound".

Figure 10:
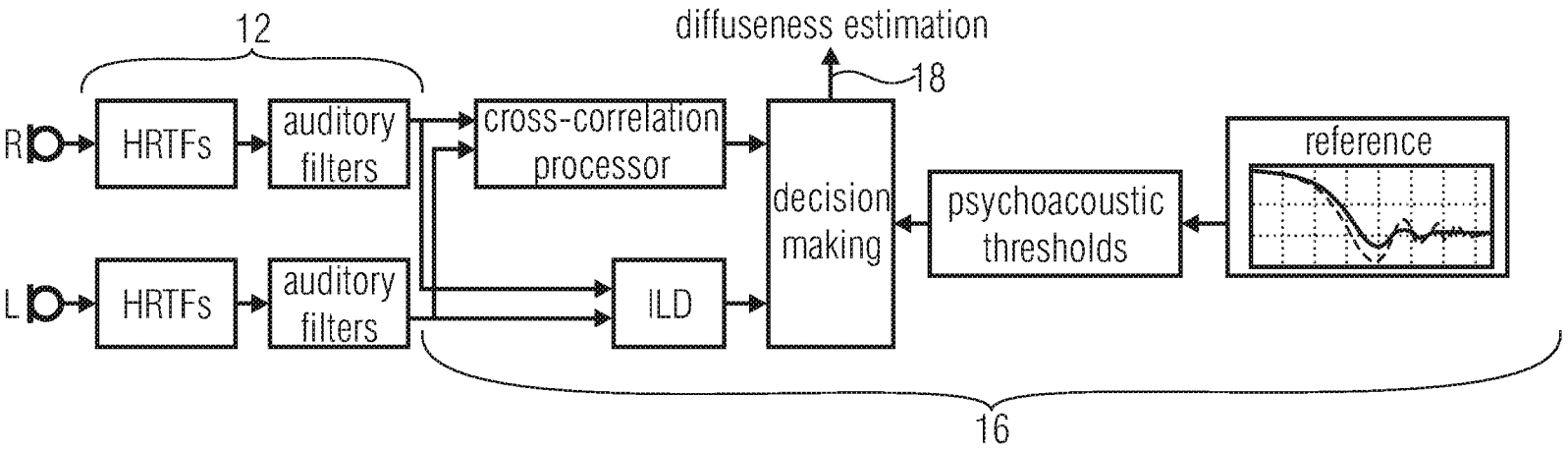
FIG. 10 illustrates a block diagram for illustrating another embodiment for a diffuseness estimation where diffuse components are the components to be decomposed.

Subsequently, FIG. 10 is described. A stationary sound fields is called diffuse, if the directional distribution of sound energy does not depend on direction. The directional energy distribution can be evaluated by measuring all directions using a highly directive microphone. In room acoustics, the reverberant sound field in an enclosure is often modeled as a diffuse field. A diffuse sound field can be idealized as a wave field that is composed of equally strong, uncorrelated plane waves propagating in all directions. Such a sound field is isotropic and homogeneous.

If the uniformity of the energy distribution is of peculiar interest, the point-to-point correlation coefficient $$r = \frac{\langle p_1(t) \cdot p_2(t) \rangle}{[\langle p_1^2(t) \rangle \cdot \langle p_2^2(t) \rangle]^{\frac{1}{2}}}$$

of the steady state sound pressures $p_1(t)$ and $p_2(t)$ at two spatially separated points can be used to assess the physical diffusion of a sound field. For assumed ideal three dimensional and two dimensional steady state diffuse sound fields induced by a sinusoidal source, the following relations can be derived:

$$r_{3D} = \frac{\sin(kd)}{kd},$$

and $$r_{2D} = J_0(kd), \text{ where } k = \frac{2\pi}{\lambda} (\text{with } \lambda = \text{wavelength})$$

is the wave number, and d is the distance between the measurement points. Given these relations, the diffusion of a sound field can be evaluated by comparing measurement data to the reference curves. Sine the ideal relations are only necessitated, but not sufficient conditions, a number of measurements with different orientations of the axis connecting the microphones can be considered.

Considering a listener in a sound field, the sound pressure measurements are given by the ear input signals $p_l(t)$ and $p_r(t)$. Thus, the assumed distance d between the measurement feints is fixed and r becomes a function of only frequency with $$f = \frac{kc}{2\pi},$$

where c is the speed of sound in air. The ear input signals differ from the previously considered free field signals due to the influence of the effects caused by the listener's pinnae, head, and torso. Those effects, substantial for spatial hearing, are described by head related transfer functions (HRTFs). Measured HRTF data may be used to incorporate these effects. We use an analytical model to simulate an approximation of the HRTFs. The head is modeled as a rigid sphere with radius 8.75 cm and ear locations at azimuth ±100° and elevation 0°. Given the theoretical behavior of r in an ideal diffuse sound field and the influence of the HRTFs, it is possible to determine a frequency dependent interaural cross-correlation reference curve for diffuse sound fields.

The diffuseness estimation is based on comparison of simulated cues with assumed diffuse field reference cues. This comparison is subject to the limitations of human hearing. In the auditory system the binaural processing follows the auditory periphery consisting of the external ear, the middle ear, and the inner ear. Effects of the external ear that are not approximated by the sphere-model (e.g. pinnae-shape, ear-canal) and the effects of the middle ear are not considered. The spectral selectivity of the inner ear is modeled as a bank of overlapping bandpass filters (denoted auditory filters in FIG. 10). A critical band approach is used to approximate these overlapping bandpasses by rectangular filters. The equivalent rectangular bandwidth (ERB) is calculated as a function of center frequency in compliance with, $$b(f_c)=24.7\cdot(0.00437\cdot f_c+1)$$

It is assumed that the human auditory system is capable of performing a time alignment to detect coherent signal components and that cross-correlation analysis is used for the estimation of the alignment time τ (corresponding to ITD) in the presence of complex sounds. Up to about 1-1.5 kHz, time shifts of the carrier signal are evaluated using waveform cross-correlation, while at higher frequencies the envelope cross-correlation becomes the relevant cue. In the following, we do not make this distinction. The interaural coherence (IC) estimation is modeled as the maximum absolute value of the normalized interaural cross-correlation function $$IC = \max_{\tau} \left| \frac{\langle p_L(t) \cdot p_R(t+\tau) \rangle}{[\langle p_L^2(t) \rangle \cdot \langle p_R^2(t) \rangle]^{\frac{1}{2}}} \right|.$$

Some models of binaural perception consider a running interaural cross-correlation analysis. Since we consider stationary signals, we do not take into account the dependence on time. To model the influence of the critical band processing, we compute the frequency dependent normalized cross-correlation function as $$IC(f_c) = \frac{\langle A \rangle}{[\langle B \rangle \cdot \langle C \rangle]^{\frac{1}{2}}}$$

where A is the cross-correlation function per critical band, and B and C are the autocorrelation functions per critical band. Their relation to the frequency domain by the bandpass cross-spectrum and bandpass auto-spectra can be formulated as follows:

$$A = \max_{\tau}\left|2\mathrm{Re}\left(\int_{f_-}^{f^+} L^*(f)R(f)e^{j2\pi f(t-\tau)}df\right)\right|,$$

$$B = \left|2\left(\int_{f_-}^{f^+} L^*(f)L(f)e^{j2\pi ft}df\right)\right|,$$

$$C = \left|2\left(\int_{f_-}^{f^+} R^*(f)R(f)e^{j2\pi ft}df\right)\right|,$$

where L(f) and R(f) are the Fourier transforms of the ear input signals, $$f^{\pm} = f_c \pm \frac{b(f_c)}{2}$$

are the upper and lower integration limits of the critical band according to the actual center frequency, and * denotes complex conjugate.

If the signals from two or more sources at different angles are super-positioned, fluctuating ILD and ITD cues are evoked. Such ILD and ITD variations as a function of time and/or frequency may generate spaciousness. However, in the long time average, there should not be ILDs and ITDs in a diffuse sound field. An average ITD of zero means that the correlation between the signals can not be increased by time alignment. ILDs can in principal be evaluated over the complete audible frequency range. Because the head constitutes no obstacle at low frequencies, ILDs are most efficient at middle and high frequencies.

Subsequently FIGS. 11A and 11B is discussed in order to illustrate an alternative implementation of the analyzer without using a reference curve as discussed in the context of FIG. 10 or FIG. 4.

A short-time Fourier transform (STFT) is applied to the input surround audio channels $x_1(n)$ to $x_N(n)$, yielding the short-time spectra $X_1(m,i)$ to $X_N(m,i)$, respectively, where m is the spectrum (time) index and i the frequency index. Spectra of a stereo downmix of the surround input signal, denoted $\overline{X}_1(m,i)$ and $\overline{X}_N(m,i)$, are computed. For 5.1 surround, an ITU downmix is suitable as equation (1). $X_1(m,i)$ to $X_5(in, i)$ correspond in this order to the left (L), right (R), center (C), left surround (LS), and right surround (RS) channels. In the following, the time and frequency indices are omitted most of the time for brevity of notation.

Based on the downmix stereo signal, filter $W_D$ and $W_A$ are computed for obtaining the direct and ambient sound surround signal estimates in equation (2) and (3).

Given the assumption that ambient sound signal is uncorrelated between all input channels, we chose the downmix coefficients such that this assumption also holds for the downmix channels. Thus, we can formulate the downmix signal model in equation 4.

$D_1$ and $D_2$ represent the correlated direct sound STFT spectra, and $A_1$ and $A_2$ represent uncorrelated ambience sound. One further assumes that direct and ambience sound in each channel are mutually uncorrelated.

Estimation of the direct sound, in a least means square sense, is achieved by applying a Wiener filter to the original surround signal to suppress the ambience. To derive a single filter that can be applied to all input channels, we estimate the direct components in the downmix using the same filter for the left and right channel as in equation (5).

The joint mean square error function for this estimation is given by equation (6).

$E\{\bullet\}$ is the expectation operator and $P_D$ and $P_A$ are the sums of the short term power estimates of the direct and ambience components, (equation 7).

The error function (6) is minimized by setting its derivative to zero. The resulting filter for the estimation of the direct sound is in equation 8.

Similarly, the estimation filter for the ambient sound can be derived as in equation 9.

In the following, estimates for $P_D$ and $P_A$ are derived, needed for computing $W_D$ and $W_A$. The cross-correlation of the downmix is given by equation 10.

where, given the downmix signal model (4), reference is made to (11).

Assuming further that the ambience components in the downmix have the same power in the left and right downmix channel, one can write equation 12.

Substituting equation 12 into the last line of equation 10 and considering equation 13 one gets equation (14) and (15).

As discussed in the context of FIG. 4, the generation of the reference curves for a minimum correlation can be imagined by placing two or more different sound sources in a replay setup and by placing a listener head at a certain position in this replay setup. Then, completely independent signals are emitted by the different loudspeakers. For a two-speaker setup, the two channels would have to be completely uncorrelated with a correlation equal to 0 in case there would not be any cross-mixing products. However, these cross-mixing products occur due to the cross-coupling from the left side to the right side of a human listening system and, other cross-couplings also occur due to room reverberations etc. Therefore, the resulting reference curves as illustrated in FIG. 4 or in FIGS. 9*a* to 9*d* are not at 0, but have values particularly different from 0 although the reference signals imagined in this scenario were completely independent. It is, however important to understand that one does not actually need these signals. It is also sufficient to assume a full independence between the two or more signals when calculating the reference curve. In this context, it is to be noted, however, that other reference curves can be calculated for other scenarios, for example, using or assuming signals which are not fully independent, but have a certain, but pre-known dependency or degree of dependency between each other. When such a different reference curve is calculated, the interpretation or the providing of the weighting factors would be different with respect to a reference curve where fully independent signals were assumed.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for decomposing an input signal comprising a number of at least three input channels, the input channels comprising a dependent part and an independent part to obtain a decomposed signal comprising at least three decomposed channels, the apparatus comprising:

a downmixer configured for downmixing the input signal to acquire a downmix signal, wherein the input signal comprises a time sequence of input channel frequency representations for each input channel, an input channel frequency representation for each input channel of the time sequence of input channel frequency representations comprising a plurality of input channel subbands, wherein the downmixer is configured for downmixing so that a number of downmix channels of the downmix signal is at least 2 and smaller than the number of input channels, and wherein the downmixer is configured to downmix the input channel frequency representations of the input channels to obtain downmix channel frequency representations of the downmix channels, wherein each downmix channel frequency representation comprises a plurality of downmix channel subbands;

an analyzer configured for analyzing the downmix signal to derive an analysis result, wherein the analyzer is configured to determine a weighting factor for a downmix channel subband, the weighting factor having a first value for a first correlation of the downmix channels in the downmix channel subband and having a second different value for a second different correlation of the downmix channels in the downmix channel subband, and to derive, as the analysis result, the weighting factor for each downmix channel subband to obtain a set of weighting factors, the set of weighting factors including a weighting factor for each downmix channel subband of the plurality of downmix channel subbands; and a signal processor configured for processing the input signal using the analysis result, wherein the signal processor is configured for weighting each input channel subband of the input channel frequency representation for each input channel using the weighting factor for the corresponding downmix channel subband from the set of weighting factors to acquire decomposed channel frequency representations for the decomposed channels, a number of the decomposed channels being greater than 2, the decomposed channels forming the decomposed signal, wherein the decomposed signal either represents the dependent part of the input channels or the independent part of the input channels.

2. The apparatus in accordance with claim 1, further comprising a time/frequency converter configured for converting the input channels from a time domain representation into the time sequence of input channel frequency representations.

3. The apparatus in accordance with claim 1, in which the signal processor is configured for applying the same weighting factor from the set of weighting factors to the corresponding input channel subbands of the input channel frequency representations of the input channels.

4. The apparatus in accordance with claim 1, in which the analyzer is configured for determining values of the weighting factors between 0 and 1, wherein the analyzer is configured to determine the first value of the weighting factor for the first correlation and the second value of the weighting factor for the second correlation, the first value being lower than the second value and the first correlation being higher than the second correlation, and wherein the processor is configured for multiplying each input channel subband of the input channel frequency representation for each input channel by the value of the weighting factor for the corresponding downmix channel, and wherein the decomposed signal represents the independent part of the input channels.

5. The apparatus in accordance with claim 1, in which the downmixer is configured for filtering the input signal using room impulse responses-based filters binaural room impulse responses-(BRIR-) based filters or head related transfer function-(HRTF-) based filters.

6. The apparatus in accordance with claim 1, in which the processor is configured for applying a Wiener filter to the input signal, and in which the analyzer is configured for calculating the Wiener filter using expectation values derived from the downmix channels.

7. The apparatus in accordance with claim 1, wherein the analyzer is configured to extract equal energy parts of all input channels and to analyze the equal energy parts of all input channels to derive the set of weighting factors.

8. The apparatus in accordance with claim 1, wherein the signal processor is configured for extracting the independent part, so that the decomposed signal represents the independent part of the input channels, and wherein the signal processor is configured to subtract, from each input channel subband, a corresponding decomposed channel subband to obtain, for the decomposed channel subband, the dependent parts of the input channels.

9. The apparatus in accordance with claim 1, wherein the processor is configured to extract an enveloping ambient signal from the decomposed signal representing the independent part using a weighting factor for the decomposed channel subband derived from a minimum energy of each decomposed channel subband in every channel of the decomposed signal.

10. A method of decomposing an input signal comprising a number of at least three input channels, the input channels comprising a dependent part and an independent part, to obtain a decomposed signal comprising at least three decomposed channels, the method comprising:

downmixing the input signal to acquire a downmix signal, wherein the input signal comprises a time sequence of input channel frequency representations for each input channel, an input channel frequency representation for each input channel of the time sequence of input channel frequency representations comprising a plurality of input channel subbands, wherein the downmixing is performed so that a number of downmix channels of the downmix signal is at least 2 and smaller than the number of input channels, and so that downmix channel frequency representations of the downmix channels are obtained, wherein each downmix channel frequency representation comprises a plurality of downmix channel analyzing the downmix signal to derive an analysis result, the analyzing comprising to determining a weighting factor for a downmix channel subband, the weighting factor having a first value for a first correlation of the downmix channels in the downmix channel subband and having a second different value for a second different correlation of the downmix channels in the downmix channel subband, and deriving, as the analysis result, the weighting factor for each downmix channel subband to obtain a set of weighting factors, the set of weighting factors including a weighting factor for each downmix channel subband of the plurality of downmix channel subbands; and processing the input signal using the analysis result, the processing comprising weighting each input channel subband of the input channel frequency representation for each input channel using the weighting factor for the corresponding downmix channel subband from the set of weighting factors to acquire decomposed channel frequency representations for the decomposed channels, a number of the decomposed channels being greater than 2, the decomposed channels forming the decomposed signal, wherein the decomposed signal either represents the dependent part of the input channels or the independent part of the input channels.

11. A non-transitory storage medium having stored thereon a computer program for performing, when the computer program is executed by a computer or processor, the method of decomposing an input signal comprising a number of at least three input channels, the input channels comprising a dependent part and an independent part, to obtain a decomposed signal comprising at least three decomposed channels, the method comprising:

downmixing the input signal to acquire a downmix signal, wherein the input signal comprises a time sequence of input channel frequency representations for each input channel, an input channel frequency representation for each input channel of the time sequence of input channel frequency representations comprising a plurality of input channel subbands, wherein the downmixing is performed so that a number of downmix channels of the downmix signal is at least 2 and smaller than the number of input channels, and so that downmix channel frequency representations of the downmix channels are obtained, wherein each downmix channel frequency representation comprises a plurality of downmix channel;

analyzing the downmix signal to derive an analysis result, the analyzing comprising to determining a weighting factor for a downmix channel subband, the weighting factor having a first value for a first correlation of the downmix channels in the downmix channel subband and having a second different value for a second different correlation of the downmix channels in the downmix channel subband, and deriving, as the analysis result, the weighting factor for each downmix channel subband to obtain a set of weighting factors, the set of weighting factors including a weighting factor for each downmix channel subband of the plurality of downmix channel subbands; and processing the input signal using the analysis result, the processing comprising weighting each input channel subband of the input channel frequency representation for each input channel using the weighting factor for the corresponding downmix channel subband from the set of weighting factors to acquire decomposed channel frequency representations for the decomposed channels, a number of the decomposed channels being greater than 2, the decomposed channels forming the decomposed signal, wherein the decomposed signal either represents the dependent part of the input channels or the independent part of the input channels.

12. An apparatus for decomposing an input signal comprising a number of at least three input channels, the input channels comprising a dependent part and an independent part, to obtain a decomposed signal comprising at least three decomposed channels, the apparatus comprising:

a downmixer configured for downmixing the input signal to acquire a downmix signal, wherein the input signal comprises a time sequence of input channel frequency representations for each input channel, an input channel frequency representation for each input channel of the time sequence of input channel frequency representations comprising a plurality of input channel subbands, wherein the downmixer is configured for downmixing so that a number of downmix channels of the downmix signal is at least 2 and smaller than the number of input channels, and wherein the downmixer is configured to downmix the input channel frequency representations of the input channels to obtain downmix channel frequency representations of the downmix channels, wherein each downmix channel frequency representation comprises a plurality of downmix channel subbands;

an analyzer configured for analyzing the downmix signal to derive an analysis result wherein the analyzer is configured to determine a weighting factor for a downmix channel subband, the weighting factor having a first value for a first correlation of the downmix channels in the downmix channel subband and having a second different value for a second different correlation of the downmix channels in the downmix channel subband, and to derive, as the analysis result, the weighting factor for each downmix channel subband to obtain a set of weighting factors, the set of weighting factors including a weighting factor for each downmix channel subband of the plurality of downmix channel subbands; and a signal processor configured for processing a derived signal derived from the input signal using the analysis result, wherein the signal processor is configured for applying the analysis result to derived channels of the derived signal to acquire the decomposed signal, wherein the derived signal is different from the downmix signal and comprises a number of the derived channels being greater than the number of downmix channels, wherein the signal processor is configured for weighting each derived channel subband of a derived channel frequency representation for each derived channel using the weighting factor for the corresponding downmix channel subband from the set of weighting factors to acquire decomposed channel frequency representations for the decomposed channels, a number of the decomposed channels being greater than 2, the decomposed channels forming the decomposed signal, wherein the decomposed signal either represents the dependent part of the input channels or the independent part of the input channels.

13. The apparatus in accordance with claim 1, further comprising a signal deriver configured for deriving the derived signal from the input signal so that the derived signal comprises the number of the derived channels being different from the number of the downmix channels and being different from the number of the input channels.

14. A method of decomposing an input signal comprising a number of at least three input channels, the input channels comprising a dependent part and an independent part, to obtain a decomposed signal comprising at least three decomposed channels, the method comprising:

downmixing the input signal to acquire a downmix signal, wherein the input signal comprises a time sequence of input channel frequency representations for each input channel, an input channel frequency representation for each input channel of the time sequence of input channel frequency representations comprising a plurality of input channel subbands, wherein the downmixer is configured for downmixing so that a number of downmix channels of the downmix signal is at least 2 and smaller than the number of input channels, and wherein the downmixer is configured to downmix the input channel frequency representations of the input channels to obtain downmix channel frequency representations of the downmix channels, wherein each downmix channel frequency representation comprises a plurality of downmix channel subbands;

analyzing the downmix signal to derive an analysis result, the analyzing comprising to determining a weighting factor for a downmix channel subband, the weighting factor having a first value for a first correlation of the downmix channels in the downmix channel subband and having a second different value for a second different correlation of the downmix channels in the downmix channel subband, and deriving, as the analysis result, the weighting factor for each downmix channel subband to obtain a set of weighting factors, the set of weighting factors including a weighting factor for each downmix channel subband of the plurality of downmix channel subbands; and processing a derived signal derived from the input signal using the analysis result, wherein the analysis result is applied to derived channels of the derived signal to acquire the decomposed signal, wherein the derived signal is different from the downmix signal and comprises a number of derived channels being greater than the number of downmix channels of the downmix signal, wherein the processing comprises weighting each derived channel subband of a derived channel frequency representation for each derived channel using the weighting factor for the corresponding downmix channel subband from the set of weighting factors to acquire decomposed channel frequency representations for the decomposed channels, a number of the decomposed channels being greater than 2, the decomposed channels forming the decomposed signal, wherein the decomposed signal either represents the dependent part of the input channels or the independent part of the input channels.

15. A non-transitory storage medium having stored thereon a computer program for performing; when the computer program is executed by a computer or processor; the method of decomposing an input signal comprising a number of at least three input channels, the input channels comprising a dependent part and an independent part, to obtain a decomposed signal comprising at least three decomposed channel, the method comprising:

downmixing the input signal to acquire a downmix signal, so that a number of downmix channels of the downmix signal is at least 2 and smaller than the number of input channels, wherein the input signal comprises a time sequence of input channel frequency representations for each input channel, an input channel frequency representation for each input channel of the time sequence of input channel frequency representations comprising a plurality of input channel subbands, wherein the downmixer is configured for downmixing so that a number of downmix channels of the downmix signal is at least 2 and smaller than the number of input channels, and wherein the downmixer is configured to downmix the input channel frequency representations of the input channels to obtain downmix channel frequency representations of the downmix channels, wherein each downmix channel frequency representation comprises a plurality of downmix channel subbands;

analyzing the downmix signal to derive an analysis result, the analyzing comprising to determining a weighting factor for a downmix channel subband, the weighting factor having a first value for a first correlation of the downmix channels in the downmix channel subband and having a second different value for a second different correlation of the downmix channels in the downmix channel subband, and deriving, as the analysis result, the weighting factor for each downmix channel subband to obtain a set of weighting factors, the set of weighting factors including a weighting factor for each downmix channel subband of the plurality of downmix channel subbands; and processing a derived signal derived from the input signal using the analysis result, wherein the analysis result is applied to channels of the derived signal to acquire the decomposed signal, wherein the derived signal is different from the downmix signal and comprises a number of derived channels being greater than the number of downmix channels of the downmix signal, wherein the processing comprises weighting each derived channel subband of a derived channel frequency representation for each derived channel using the weighting factor for the corresponding downmix channel subband from the set of weighting factors to acquire decomposed channel frequency representations for the decomposed channels, a number of the decomposed channels being greater than 2, the decomposed channels forming the decomposed signal, wherein the decomposed signal either represents the dependent part of the input channels or the independent part of the input channels.

* * * * *